US005347665A

United States Patent [19]

Kumon et al.

[11] Patent Number: 5,347,665

[45] Date of Patent: Sep. 20, 1994

[54] CARBONATE SPRING BATH SYSTEM

[75] Inventors: Naoki Kumon, Hirakata; Harue Kawagoe, Kobe; Shin Matsugi, Osaka; Hiroshi Kano, Shijonawate; Noriyoshi Nakaoka, Kadoma; Shoichi Morii, Hirakata; Shigekazu Kusanagi, Katano; Kenji Koi, Osaka; Takashi Hatai; Masanori Fukui, both of Shijonawate, all of Japan

[73] Assignee: Matsushita Electric Works, Ltd., Osaka, Japan

[21] Appl. No.: 950,172

[22] Filed: Sep. 24, 1992

[30] Foreign Application Priority Data

| | | | |
|---|---|---|---|
| Sep. 25, 1991 | [JP] | Japan | 3-243932 |
| Oct. 15, 1991 | [JP] | Japan | 3-265619 |
| Jan. 27, 1992 | [JP] | Japan | 4-012445 |
| Jan. 27, 1992 | [JP] | Japan | 4-012447 |

[51] Int. Cl.[5] ..... E03C 1/02

[52] U.S. Cl. ..... 4/541.1; 4/541.4; 4/541.5; 607/81; 607/85

[58] Field of Search ..... 4/541.1, 541.2, 541.3, 4/541.4, 541.5, 541.6; 261/DIG. 7, 16, 64.1, 64.5; 607/81, 84, 85, 86

[56] References Cited

U.S. PATENT DOCUMENTS

| | | | |
|---|---|---|---|
| 1,860,009 | 5/1932 | Belt | 607/85 |
| 2,512,091 | 6/1950 | Derome | 4/541.5 |
| 3,048,164 | 8/1962 | Walker | 261/DIG. 7 |
| 4,173,178 | 11/1979 | Wieland | 261/64.1 |
| 4,882,097 | 11/1989 | Shannon | 261/DIG. 7 |
| 4,904,418 | 2/1990 | Ziesel et al. | 261/DIG. 7 |
| 4,907,305 | 3/1990 | Teramachi et al. | 4/542 |

FOREIGN PATENT DOCUMENTS

| | | | |
|---|---|---|---|
| 47587 | 2/1991 | Japan | 4/541.3 |
| 131259 | 6/1991 | Japan | 4/541.5 |
| 3-131259 | 6/1991 | Japan . | |
| 3161090 | 7/1991 | Japan | 4/541.1 |

*Primary Examiner*—Henry J. Recla
*Assistant Examiner*—Charles R. Eloshway
*Attorney, Agent, or Firm*—Armstrong, Westerman, Hattori, McLeland & Naughton

[57] ABSTRACT

A carbonate spring bath system creates a bath water dissolved with $CO_2$ gas and supplies the same to a bathtub. The system includes a source of a concentrated $CO_2$ gas, a circulation path connected to the bathtub and including a booster pump for circulating a bath water from and into the bathtub. $CO_2$ gas and air supply lines are connected to the circulation path upstream of the pump. The $CO_2$ gas and air supply lines includes valves which are opened and closed to provide the $CO_2$ gas and the air at a suitable mixture ratio such that the $CO_2$ gas and air are forced to dissolve in the pressurized bath water. Disposed downstream of the pump is an accumulator for separating undissolved gas in the bath water and storing in a gas chamber the undissolved gas emanating from the bath water. A recycle line connects the gas chamber to the circulation path upstream of the pump to return the undissolved gas to the circulation path. An exhaust line is connected to the gas chamber for exhausting the undissolved gas outwardly. The recycle and exhaust lines are provided respectively with valves which are controlled to open and close such that the system can selectively operates a recycle mode and an exhaust mode.

18 Claims, 15 Drawing Sheets

START
START BOOSTER PUMP
SELECTRION BETWEEN CARBONATE SPRING BATH & AIR MICRO-BUBBLING BATH
CARBONATE SPRING BATH SELECTED
NO
AIR MICRO-BUBBLING BATH
A
YES
CO2 CONCENTRATION ANALYSIS
B
CO2 > 95%
YES
RECYCLE MODE WITH AIR SUPPLY
C
C'
NO
CO2 > 70%
YES
RECYCLE MODE WITHOUT AIR SUPPLY
D
NO
CO2 > 50%
YES
RECYCLE - EXHAUST MODE WITHOUT AIR SUPPLY
E
NO
EXHAUST MODE WITHOUT AIR SUPPLY
F

CARBONATE SPRING BATH SYSTEM

BACKGROUND OF THE INVENTION

1. Field of the Invention

The present invention is directed to a carbonate spring bath system, and more particularly to, such a system for creating a bath water dissolved with carbon dioxide [$CO_2$] gas and supplying the same to a bathtub.

2. Background of the Invention

A carbonate spring bath system has been already proposed in Japanese Patent Publication [KOKAI] No. 3-131259 in which $CO_2$ gas is dissolved together with a small amount of an air into a bath water to be supplied into a bathtub so that a user can enjoy a carbonate spring bath in one's home. The system includes a booster pump for circulating the bath water from and into a bathtub as well as for dissolving the $CO_2$ gas and air into the bath water at an elevated pressure. An accumulator is provided downstream of the pump in order to separate undissolved or excess amount of the $CO_2$ gas and the air from the bath water and feed the bath water, thereby assuring to feed the bath water into which the $CO_2$ gas and the air are successfully dissolved, and therefore preventing the undissolved $CO_2$ and air from being fed into a bathtub. The separation of the undissolved $CO_2$ and air is essentially in that if the undissolved gas is fed along with the bath water into the bath, large bubbles of the $CO_2$ gas and the air are very likely to occur in the bathtub to thereby give off a large proportion of the $CO_2$ gas, i.e., reduce the content of the dissolved $CO_2$ gas, which greatly lowers the effect of the carbonate spring bath. However, with the use of the accumulator, there remains a problem in that the $CO_2$ gas separated as the undissolved gas in the accumulator is discharged wastefully. Further, the system is capable of dissolving the air in the bath water such that the dissolved air can form micro bubbles in the bath water after introduced into the bathtub and depressurized therein. To obtain an adequate amount of the air, the system is designed to best utilize a combustion gas of a hydrocarbon fuel as a source of the mixture gas of the $CO_2$ gas and the air. However, when the system is modified to receive the $CO_2$ gas from a pure $CO_2$ source, for example, a $CO_2$ bottle or chemical apparatus of forming a pure $CO_2$ gas by chemical formation, the system is not capable of producing an air bubbling.

SUMMARY OF THE INVENTION

In view of the above problems and insufficiencies, the present invention has been accomplished to provide an improved carbonate spring bath system which is capable of recycling the $CO_2$ gas with improved economy and of allowing the selective use of substantially a pure $CO_2$ source and a source of producing a mixture of the $CO_2$ gas and the air while assuring to create an air bubbling in addition to dissolving the $CO_2$ gas in the bath water. The improved carbonate spring bath system in accordance with the present invention includes a source of supplying a concentrated $CO_2$ gas and a circulation path connected to a bathtub at an inlet and an outlet and including a booster pump for circulating to introduce a bath water through the inlet from the bathtub and feeding the same back thereto through the outlet as a pressurized bath water. A $CO_2$ gas supply line is connected to the circulation path upstream of the booster pump to feed the concentrated $CO_2$ gas from the source to the bath water circulating in the circulation path. Also, an air supply line is connected to the circulation path upstream of the booster pump to feed an outside air to the bath water circulating in the circulation path. The $CO_2$ gas supply line and the air supply line are provided respectively with valves which are opened and closed so as to provide to the circulation path the $CO_2$ gas and the air at a suitable mixture ratio thereof such that the $CO_2$ and the air are forced by the booster pump to dissolve in the pressurized bath water under a pressurized condition. Disposed in the circulation path downstream of the booster pump is an accumulator for separating undissolved gas which has been involved in the bath water at the time of dissolving the $CO_2$ gas and the air by the booster pump at an elevated pressure. The accumulator has a water chamber for temporarily storing the pressurized bath water and a gas chamber for storing the undissolved gas emanating from the pressurized water. A recycle line is provided to connect the gas chamber in the accumulator to the circulation path upstream of the booster pump so as to return the undissolved gas to the circulation path for recycling of the undissolved gas. Also connected to the gas chamber is an exhaust line for exhausting the undissolved gas outside of the circulation path. The recycle line and exhaust line are provided respectively with valves which are selectively opened and closed such that the system is capable of selectively operating a recycle mode in which the undissolved gas is fed back to the circulating bath water and an exhaust mode in which the undissolved gas is exhausted outside of the circulation path. With the provision of the air supply line in addition to the $CO_2$ supply line, it is readily possible or adapted to receive the $CO_2$-air mixture at an optimum $CO_2$ concentration either from a pure $CO_2$ source such as a $CO_2$ bottle or a $CO_2$-air mixture source such as a combustion apparatus which obtain a concentrated $CO_2$ gas from the combustion gas of a hydrocarbon fuel. Further, with the provision of the recycle and exhaust lines, it is readily possible to select the recycle mode and the exhaust mode based upon the differing concentrations of the $CO_2$ gas being supplied from the source. That is, when a very rich $CO_2$ gas, for example, 95 vol % or more $CO_2$ content is supplied, the system is capable of operating in the recycle mode to recycle the $CO_2$ gas which has not been dissolved at a time in the circulating bath water for efficient and economical use of the $CO_2$ gas. On the other hand, when a relatively poor $CO_2$ gas, for example, 50 vol % or less content is supplied, the system can be set into the exhaust mode for accelerating to build up the total dissolved amount of the $CO_2$ gas in the bath water at the waste of only a small amount of the gas. This is because that, at a relatively low $CO_2$ content, almost all of the $CO_2$ gas can be dissolved at a time in the bath water so that only a small amount of the $CO_2$ gas remains undissolved and is collected in the gas chamber of the accumulator. In contrast, due to considerably less solubility of the air into the water, which is approximately one-fourtyfourth (1/44) of that of the $CO_2$ gas, as the air proportion is increased, more amount of the air is collected and remains in the gas chamber of the accumulator. Consequently, it is not effective to return the air in the circulation path as the recycling air can be only dissolved in the bath water over a very prolonged time period of continuing circulating the bath water from and into the bathtub. In this condition, the system selects the exhaust mode to operate efficiently for proving a carbonate spring bath of a desired $CO_2$ gas dissolved content. Further, when a relatively rich $CO_2$ gas, for example, 50 to 95 vol % $CO_2$ content is supplied, the system can operate on a combination of the recycle and exhaust modes.

Accordingly, it is an object of the present invention to provide an improved carbonate spring bath system which enables use of different $CO_2$ gas supply sources of differing $CO_2$ concentrations and operate in an efficient and economic manner.

The system includes a $CO_2$ sensor which detects a $CO_2$ concentration of the $CO_2$ gas being fed to the bath water in the circulation path and provides a corresponding output to a control unit. The control unit responds to open and close the valves of the recycle and exhaust lines for selecting the operation between the recycle mode and the exhaust mode. Accordingly, the system can automatically select the recycle and exhaust modes based upon thus detected $CO_2$ concentration of the gas being fed from the $CO_2$ source for assuring efficient and economical operation of dissolving the $CO_2$ gas into the bath water, which is therefore another object of the present invention.

Alternately, the output of the $CO_2$ sensor may be processed to control the opening and closing of the valves in the $CO_2$ gas supply line and the air supply line in a feedback manner to keep supplying the mixture gas of $CO_2$ and air at an optimum ratio.

It should be noted in this connection that at least 5 vol % of the air in the supply gas is essential in order to form air micro-bubbles in the bathtub and keep the $CO_2$ gas dissolved in the bathtub, although an exact mechanism is not known. In other words, if the gas being supplied to the bath water circulating in the circulation path contains less than 5% of air, large bubbles of $CO_2$ gas will occur as the $CO_2$ dissolved bath water emerges into the bathtub with attendant depressurization, which means that the dissolved $CO_2$ gas will quickly rise in bubbles and therefore fails to be dissolved over a prolonged time into the water of the bathtub, thereby lowering the spring bath therapy effect. To this end, the system is required to receive a suitable amount of air along with the $CO_2$ gas. When, for example, a $CO_2$ gas bottle providing nearly 100 vol % of $CO_2$ gas is selected as the $CO_2$ gas source, the air supply line is to be opened to supply a suitable amount of air along with the $CO_2$ gas for supplying the mixture gas of 95% $CO_2$ and 5% air. On the other hand, when the $CO_2$ gas source is selected to supply 95% or less of the $CO_2$ gas, the system is set to close the air supply line for supplying the mixture gas of 95% or less $CO_2$.

In a preferred embodiment, the accumulator is provided with a level sensor for sensing a water level of the bath water in the accumulator. The above $CO_2$ sensor is realized by the level sensor and the control unit which controls to open the $CO_2$ gas line for a limited time period to supply a predetermined amount of the $CO_2$ gas from the $CO_2$ source through the $CO_2$ gas line to the bath water circulating in the circulation path, while operating the booster pump in order to dissolve the supplied $CO_2$ gas into the bath water with the recycle line opened and with the exhaust line closed, during which the level sensor monitors a water level variation of the bath water in the accumulator reflecting a degree of the $CO_2$ gas being dissolved in the bath water. Then, the control unit calculates a level rise rate of the bath water as indicative of the concentration of the $CO_2$ gas supplied from the source. With this arrangement, the accumulator is best utilized to detect the $CO_2$ concentration of the $CO_2$ gas being supplied without requiring any other $CO_2$ sensor which adds to the cost of the system.

It is therefore a further object of the present invention to provide an improved carbonate spring bath system in which the accumulator is best utilized to monitor the $CO_2$ gas concentration so that the system can be realized in an economical manner.

In addition, the present invention discloses advantageous controls of selecting an effective operation mode depending upon the detected $CO_2$ concentration of the $CO_2$ gas being supplied to the bath water circulating in the circulation path. Such controls include selection of the recycle mode, the exhaust mode, as well as the recycle-exhaust mode. In the recycle mode which is selected when the $CO_2$ concentration of the supplied gas is, for example, above 70%, the control units firstly operates to supply the mixture of the $CO_2$ and the air in a constant amount to the bath water circulating in the circulation path with the recycle line opened. Then, the control unit operates to stop supplying the mixture gas and continues to feed back the undissolved $CO_2$ gas through the recycle line to the bath water upstream of the booster pump until the water level in the accumulator rises to a predetermined upper limit. The upper limit is selected to a level at which the undissolved gas separated in the gas chamber of the accumulator contains a large proportion of the air which is not expected to be further dissolved in the bath water. Upon the water level reaching the upper limit, the control units operates to again supply the constant amount of the mixture gas to the bath water and repeats the above recycle step of feeding back the $CO_2$ gas back from the accumulator to the circulating bath water. In addition to determination of the end of the recycling, the accumulator is also utilized to control the amount of the supplying gas by monitoring the water level in the accumulator from the fact that the water level will lower as the supplying amount of the gas increases. That is, during the operation of supplying the mixture gas to the bath water, the control units monitors the water level and stops supplying the gas when the water level lowers to a predetermined lower level.

In the exhaust mode, which is selected when the $CO_2$ concentration of the supplied gas is, for example, below 50%, the control unit operates to continuously supply the mixture gas at substantially a constant flow rate to the bath water in the circulation path while periodically opening and closing the exhaust line in such a manner that the exhaust line is opened when the water level is sensed to drop to a predetermined lower limit and is closed when the water level is sensed to rise to a predetermined upper limit. In this manner, the water level in the accumulator is kept within a certain range so that the accumulator is free from excessive variation of the water level, thereby preventing the outflow of the water through the exhaust line as well as preventing the undissolved gas from intermingled again into the bath water.

The recycle-exhaust mode, which is a sequential combination of a modified recycle mode and the exhaust mode, is selected when the $CO_2$ concentration of the supplied gas is, for example, from 50 to 70%. Firstly, the control units starts the recycle mode to supply the constant amount of the mixture gas and thereafter operates to recycle the undissolved gas from the accumulator back into the bath water in the circulation path until the rising rate of the water level is decreased to a certain value. The value is selected to be a minimum rate which reflects that no further substantial dissolving of the gas separated in the accumulator takes place. To explain in detail, as the $CO_2$ gas separated in the accumulator is recycled and dissolved in the bath water in the absence of a fresh supply of the mixture gas, the water level in the accumulator will increase firstly remarkably and then slowly with attendant decrease in the water rise rate. Therefore, before the rise rate dropped to the minimum rate, almost all of the $CO_2$ gas is recycled and dissolved while the air remains undissolved. Thereafter, the control units starts the exhaust mode in which the exhaust line is opened to discharge residual gas chiefly composed of the air from the accumulator outside of the circulation path until the water level rises to a predetermined upper limit. Upon this occurrence, the control unit operates to close the exhaust line and again starts the recycle mode by supplying the constant amount of the mixture gas. In this manner, the recycle and exhaust modes are repeated to dissolve the gas into the bath water efficiently and effectively, which is therefore a still further object of the present invention.

Preferably, the system includes a $CO_2$ monitor which monitors a $CO_2$ content of the bath water sampled from the bathtub and provides an output indicative of the $CO_2$ content. The output is fed to a display by which a user is informed of the $CO_2$ content of the bath water in the bathtub.

The output of the above $CO_2$ may be utilized in the control unit to control, in response to the monitored $CO_2$ content, the operation of the booster pump in such a manner as to keep or adjust the $CO_2$ content in the bathtub at or to a desired level.

The present invention also disclose a unique and advantageous structure of such $CO_2$ monitor which is capable of correctly monitoring the dissolved content of the $CO_2$ gas in the bath water, and which is readily adapted for use in monitoring the $CO_2$ gas in carbonated liquids such as beer and soda water beverages.

These and still other objects and advantageous features of the present invention will become more apparent from the following description of the preferred embodiment when taken in conjunction with the attached drawings.

DETAILED DESCRIPTION OF THE EMBODIMENT

Figure 1:
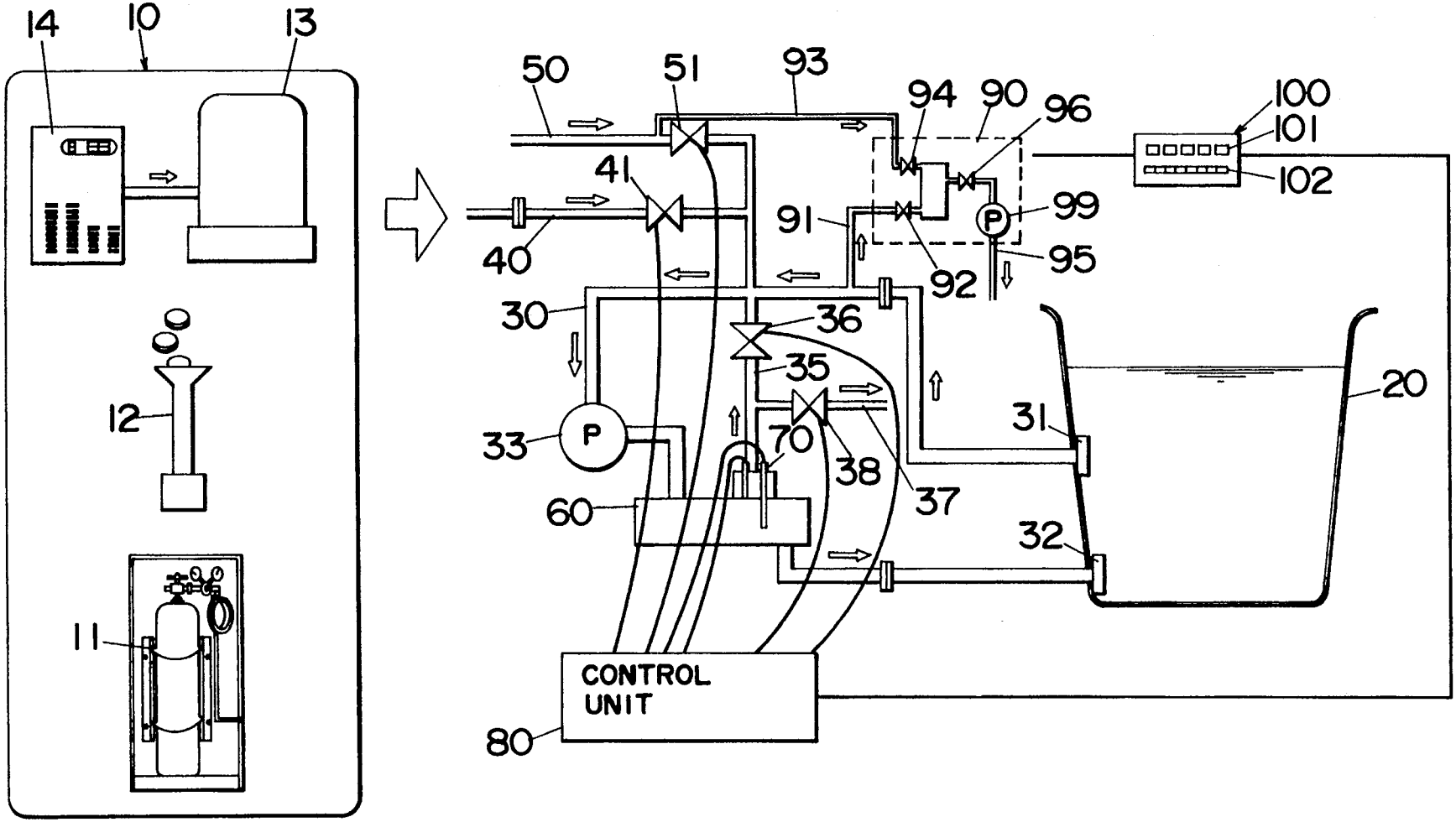
FIG. 1 is a schematic diagram illustrating a carbonate spring bath system in accordance with a preferred embodiment of the present invention.

Referring now to FIG. 1, there is shown a carbonate spring bath system in accordance with a preferred embodiment of the present invention. The system comprises a supply source 10 of supplying a concentrated carbon dioxide [$CO_2$] gas, a bathtub 20 containing a volume of bath water, and a circulation path 30 connected to the bathtub 20 at an inlet 31 and an outlet 32 for circulation of the bath water from and into the bathtub 20 through the inlet 31 and outlet 32. A booster pump 33 is provided in the circulation path 30 for driving to circulate the bath water as well as for dissolving the $CO_2$ gas and an air into the bath water circulating the path 30. To this end, a gas supply line 40 extends from the supply source 10 and terminates in the circulation path 30 upstream of the booster pump 33 to supply the concentrated $CO_2$ gas with or without the air to the bath water in the circulation path. Also connected to the circulation path 30 upstream of the booster pump 33 is an air supply line 50 for supplying the air to the bath water when no substantial amount of the air is expected to be supplied from the source 10. The gas and air supply lines 40 and 50 are provided respectively with valves 41 and 51.

It should be noted in this connection that the system necessitates a certain amount of air, preferably at least 5 vol % of air along with the $CO_2$ gas in order to form air micro-bubbles and keep $CO_2$ gas dissolved in the bathtub 20 over a prolonged time for enhanced spring bath effect. Although an exact mechanism is not known, it is empirically demonstrated that when a limited amount of the air is dissolved together with a large amount of the $CO_2$ gas into the bath water at a pressurized condition, the dissolved $CO_2$ gas is very reluctant to form large bubbles upon the bath water coming into the bathtub through the outlet 32 as being depressurized. In other words, if no substantial amount of the air is dissolved in the pressurized bath water, large bubbles of the $CO_2$ gas will appear when the bath water flows into the bathtub as being depressurized. If this occurs the $CO_2$ gas rises quickly in the form of the large bubbles and fails to be dissolved in the bath water within the bathtub. On the other hand, with the dissolution of the limited amount of the air in the bath water together with the $CO_2$ gas, there appear in the bathtub only micro-bubbles which remains in the bath water over a long period, and which is thought to inhibit quick lowering of the dissolved content of the $CO_2$ gas. Two assumptions may account for this phenomenon. One is that the micro-bubbles are formed substantially from the air, and the other is that, even if the micro-bubbles substantially contain the $CO_2$ gas, the micro-bubbles remain in the bath water over a long period and therefore give increased chances of re-dissolving the $CO_2$ gas into the bath water. In any event, it is revealed that at least 5% of the air is necessary in the concentrated $CO_2$ gas to be supplied to the circulation path for the purpose of keeping the $CO_2$ contents in the bath water of the bathtub 20 at a desired level over a prolonged period. In the present invention, it is contemplated to dissolve the $CO_2$ gas in the bath water of the bathtub 20 up to 250 ppm or more for enhancing carbonate spring bath effect. Such $CO_2$ dissolved content can be maintained over a prolonged period for the above reason.

The supply source 10 may include a $CO_2$ bottle Supplying a nearly 100% pure $CO_2$ gas, a chemical apparatus 12 forming a nearly 100% pure $CO_2$ gas by chemical formation, and a $CO_2$ concentration device 13 for obtaining concentrated $CO_2$ gas from combustion gas of a hydrocarbon fuel exhausted from a combustor 14 which may be a boiler for heating the bath 20. When the $CO_2$ bottle 11 or the chemical apparatus 12 is selected as the supply source, the air supply line 50 is opened to supply an outside air which is mixed to the pure $CO_2$ gas through the gas supply line 40 for feeding a mixture gas of the $CO_2$ and the air, preferably at 95% to 5% ratio, to the circulation path 30. The $CO_2$ concentration device 13 is capable of normally supplying the mixture gas of $CO_2$ and air having a $CO_2$ concentration of 50 to 95% with sufficient amount of the air. Therefore, when the device is selected, no additional supply of the outside air is needed and the air supply line 50 is kept closed. However, the air supply line 50 may be opened as necessary to supply an additional amount of the air when the device 13 supplies the $CO_2$ gas of 95% or more $CO_2$ concentrations.

Figure 2:
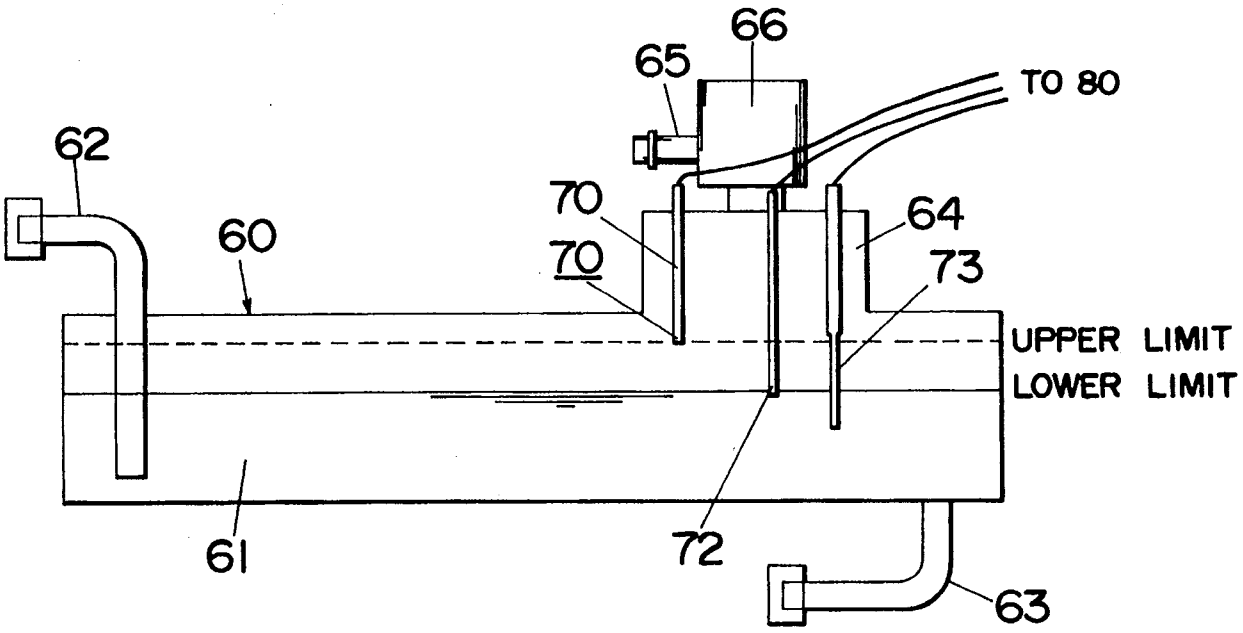
FIG. 2 is an internal view of an accumulator utilized in the above system.

Disposed in the circulation path 30 downstream of the booster pump 33 is an accumulator 60 for temporarily storing the pressurized bath water in order to prevent pulsation of the bath water being fed through the circulation path and as well to separate undissolved gas which is involved in the bath water at the pressurization by the booster pump 33. Such undissolved gas is inherently present in a large amount since an excessive amount of the mixture gas is supplied to the circulation path 30 in an attempt to dissolve more amount of the gas into the bath water by pressurization at the booster pump 33. As shown in FIG. 2, the accumulator 60 is formed to have a water chamber 61 and a gas chamber 64 upwardly thereof. The water chamber 61 is connected to the circulation path 30 through an inflow pipe 62 and an outflow pipe 63 to temporarily store the pressurized bath water fed from the booster pump 33 through the inflow pipe 62 and feed the bath water to the bathtub 20 through the outflow pipe 63. The gas chamber 64 stores the undissolved gas being separated from bath water in order to selectively feed back the gas into the circulation path 30 upstream of the pump 33 and discharge the gas outside of the path 30. For this purpose, the gas chamber 64 is connected to the circulation path by way of a recycle line 35 with a recycle valve 36 and is communicated with the outside air by way of an exhaust line 37 with an exhaust valve 38. The recycle line 35 and the exhaust line 38 are connected to the gas chamber 64 commonly through a pipe 65 and a constrictor 66 which reduces the outflow amount of the gas from the gas chamber 64 to the lines 35 and 37. As discussed in detail hereinafter, a water level in the accumulator 60 will vary over within a limited distance depending upon the dissolved content of the $CO_2$ in the pressurized bath water which in turn varies with the varying amount of the mixture gas supplied to the circulation path and with the varying outflow amount of the gas from the gas chamber 64. In order to sense the variation of the water level, the accumulator 64 includes a level sensor 70 which comprises first, second and third electrodes 71 to 73 extending vertically down to different levels. The first and second electrodes 71 and 72 define an upper limit and an lower limit, respectively of the bath water, while the third electrode 73 has its bottom end immersed deep into the bath water past the lower limit so as to serve as a common electrode to the first and second electrodes 71 and 72. The level sensor 70 provides an output to a control unit 80 which is capable of calculating a level rise rate of the water level in the accumulator 60 for the reason as discussed hereinafter.

Also included in the system is a $CO_2$ monitor 90 for monitoring the dissolved content of the $CO_2$ gas in the bath water sampled from the bathtub 20. For this purpose, the $CO_2$ monitor 90 is connected through a water feed channel 91 to the circulation path 30 between the inlet 31 and the booster pump 33 to receive the bath water from the bathtub 20. For the reason as discussed in detail hereinafter, the $CO_2$ monitor 90 is also connected the air supply line 50 upstream of the valve 51 through an air channel 93 to receive the outside air and is connected to a drain channel 95 for releasing the bath water as well as air therefrom. A control panel 100 is provided adjacent to the bathtub 20 and receives an output from the $CO_2$ monitor 90 for indication of the monitored $CO_2$ content at a display 101 so that a user can be readily informed of the monitored $CO_2$ content. The control panel 100 includes a switch and selector section 102 for turning on and off the system as well as selecting between a carbonate spring bath of dissolving the $CO_2$ gas in the bath water while forming air micro-bubbles in the bathtub and an air micro-bubbling bath of forming only air micro-bubbles without the $CO_2$ gas dissolution. In addition, the switch and selector section 102 includes a switch for activating the $CO_2$ monitor 90 to display the monitored $CO_2$ content.

The control panel 100 is linked to the control unit 80 which controls the booster pump 33, valves 41 and 51, and valves 36 and 38, based upon the output from the level sensor 70 of the accumulator 60 as well as the output from the control panel 100 and from the $CO_2$ monitor 90, in order to effectively dissolve the $CO_2$ gas into the bath water and to obtain a desired dissolved content of the $CO_2$ gas, for example, 250 ppm in the bathtub 20. Operation will be now discussed with reference to the flowcharts of FIGS. 3 to 10.

Initialization Sequence

Figure 3:
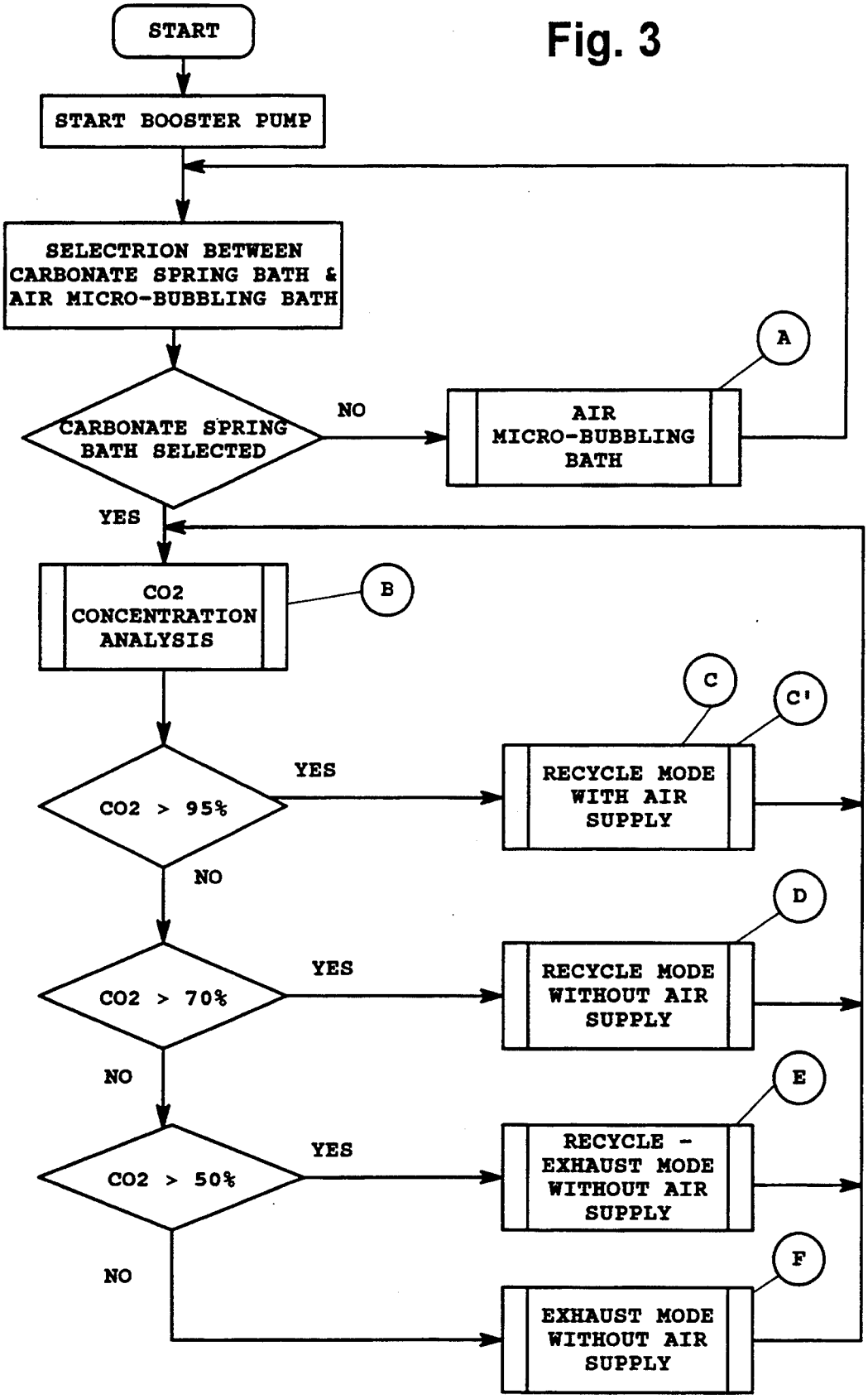
FIGS. 3 to 10 are flow-charts illustrating operations of the above system.

As shown in FIG. 3, upon turning of the system at the control panel 100, the control unit 100 responds to start the booster pump 33 and check which of the carbonate spring bath and the air micro-bubbling is selected. When the air micro-bubbling bath is selected, the control unit 80 instructs to perform a requested operation, indicated by a subroutine A, which continues until the user turns off the system, the detail of which will be explained in later with reference to the flowchart of FIG. 9. When, on the other hand, the carbonate spring bath is selected, a control is firstly made to analyze, at a subroutine B, the $CO_2$ concentration of the $CO_2$ gas supplied through the gas supply line 40 from the source 10. Thereafter, a selection is made based upon the $CO_2$ analysis among four modes. For example, when the $CO_2$ concentration of the supply gas is detected to be greater than 95%, a recycle mode with air supply is selected (indicated by a subroutine C). When the $CO_2$ concentration is from 70 to 95%, a recycle mode without air supply is selected (subroutine D). When the $CO_2$ concentration is from 50 to 70%, a recycle-exhaust mode without air supply is selected (subroutine E). When the $CO_2$ concentration is lower that 50%, an exhaust mode is selected (subroutine F).

Analysis of the $CO_2$ Concentration of the Supply Gas

Figure 4:
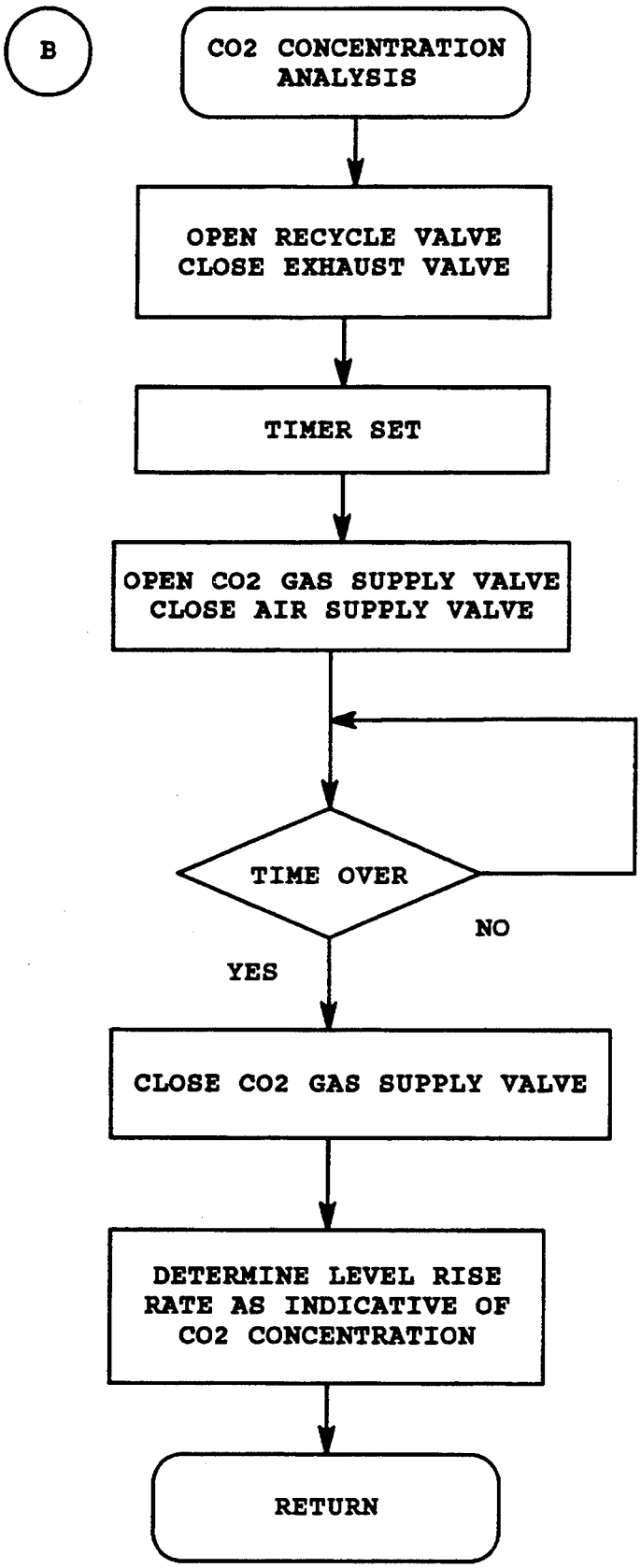

In the subroutine B, as shown in FIG. 4, a first step is made to open the recycle valve 36 and close the exhaust valve 38 followed by setting a timer to start counting a time. Simultaneously, the $CO_2$ gas supply valve 41 is opened with the air supply valve 51 kept closed to start supplying the gas of the unknown $CO_2$ concentration from the source 10 to the bath water circulating in the circulation path 30. Upon elapse of a predetermined time [time over] or after supplying a predetermined amount of the gas to the circulation path 30, the $CO_2$ gas supply valve 41 is closed while the pump 33 continues to circulate the bath water with the recycle valve 36 kept opened. Thus, the undissolved gas separated at the accumulator 60 is recycled in order to be dissolved into the circulating bath water. In consideration of that the $CO_2$ gas exhibits a much greater solubility to water than the air, the $CO_2$ gas remaining in the undissolved gas from the accumulator 60 will be readily and promptly dissolved while being recycled but the air in the undissolved gas from the accumulator is difficult to be further dissolved into the bath water. This means that, during the recycling, the water level will initially rise promptly as the dissolving amount of the $CO_2$ gas increases but will subsequently rise slowly after the $CO_2$ gas has been substantially entirely dissolved in the bath water. Accordingly, a level rise rate of the water level in the accumulator 60 is found to be directly proportional to the $CO_2$ concentration of the supply gas and is well indicative thereof. To this end, the control unit 80 calculates the level rise rate of the bath water in the accumulator 60 by the use of the output from the level sensor 70. That is, the control unit SO processes the level rise rate of the bath water rising from the lower limit defined by the electrode 72 to the upper limit defined by the electrode 71 in the accumulator 60, and determines the $CO_2$ concentration with reference to known data acquired for the relationship between the $CO_2$ concentration and the level rise rate. Thereafter, a control is made to select one of the four modes in accordance with thus determined $CO_2$ concentration of the supply gas.

Recycle Mode With Air Supply

Figure 5:
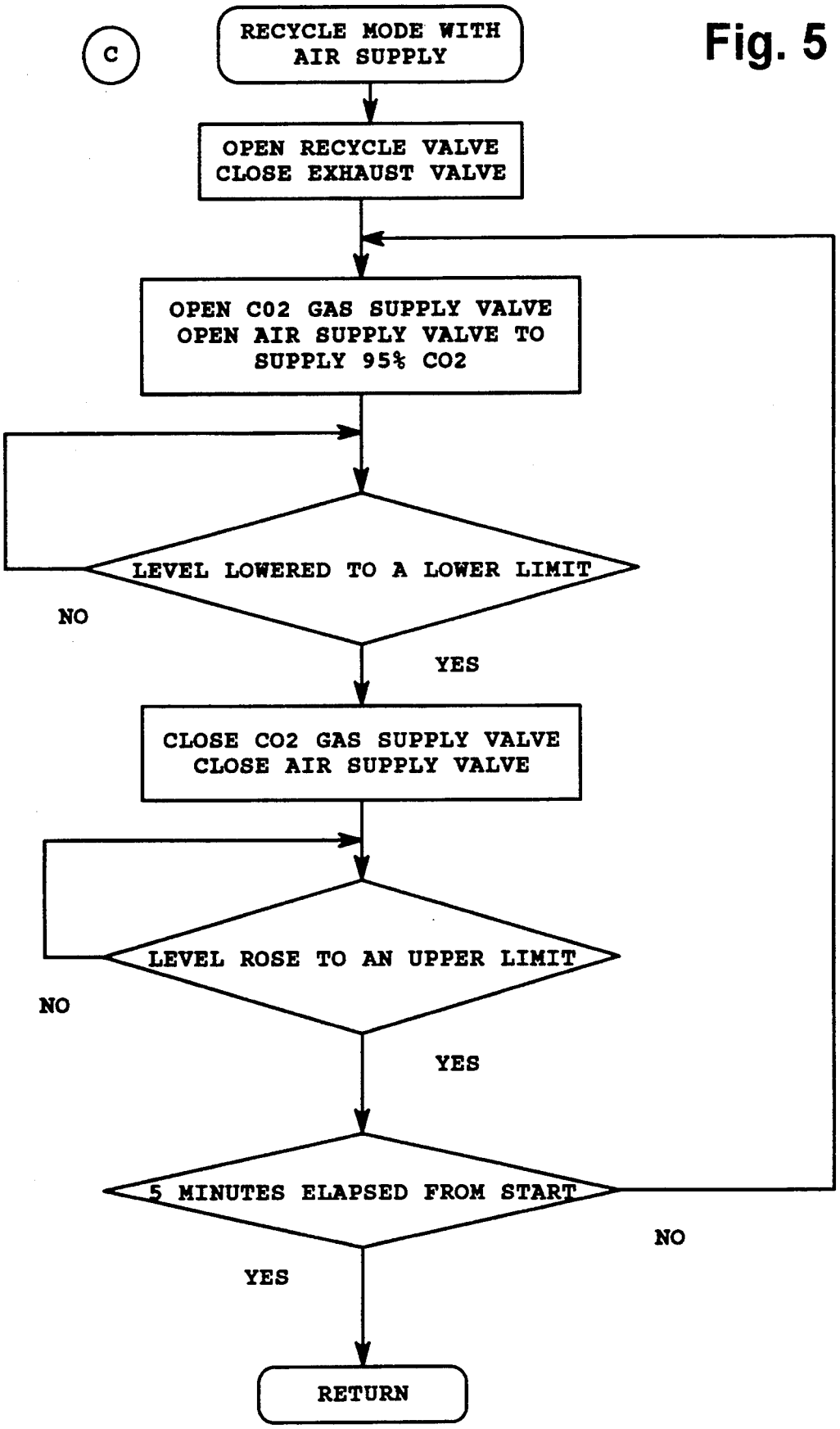

When the $CO_2$ concentration exceeds 95%, the control unit 80 selects the recycle mode with air supply to proceed to perform the subroutine C. As shown in FIG. 5, the subroutine C starts with opening the recycle valve 36 and closing the exhaust valve 38 if they have been set into the reverse conditions, respectively. Then, the $CO_2$ gas supply valve 41 and the air supply valve 51 are opened in such a manner as to provide to the circulating bath water a mixture gas containing approximately 95% of $CO_2$ and 5% of air. As discussed hereinbefore, at least 5% of the air should be additionally supplied for obtaining effective carbonate bath with air micro-bubbling. As the mixture gas is supplied, the water level of the accumulator 60 is lowered with the increase of the undissolved gas. When the water level is lowered to the lower limit within the accumulator 60, the control unit 80 acknowledges that a suitable amount of the mixture gas has been supplied and responds to close the $CO_2$ gas supply valve 41 and the air supply valve 51. Whereby, the undissolved gas continues recycling without receiving the fresh supply of the mixture. As the recycling proceeds to dissolve the recycling gas, the water level in the accumulator 60 rises to the upper limit, at which condition the control unit 80 judges that the air is predominant in the undissolved gas and therefore no further recycling is unnecessary, thereby completing one operation cycle and going back to reopen the $CO_2$ gas supply valve 41 and the air supply valve 51 for another fresh supply of the mixture gas to the circulating bath water. Thereafter, the same steps are repeated to increase the dissolved contents of the $CO_2$ gas in the bath water. Prior to reopening the valves 41 and 51, the control unit 80 checks whether, for example, 5 minutes have been elapsed from the start of the one operation cycle and, if so, the subroutine is interrupted and returned to the step of $CO_2$ analysis in the initialization sequence of FIG. 3, in order to again analyze the $CO_2$ concentration and select a suitable one of the four modes based upon the newly analyzed $CO_2$ concentration. Otherwise, the operation cycle is repeated.

Recycle Mode Without Air Supply

Figure 6:
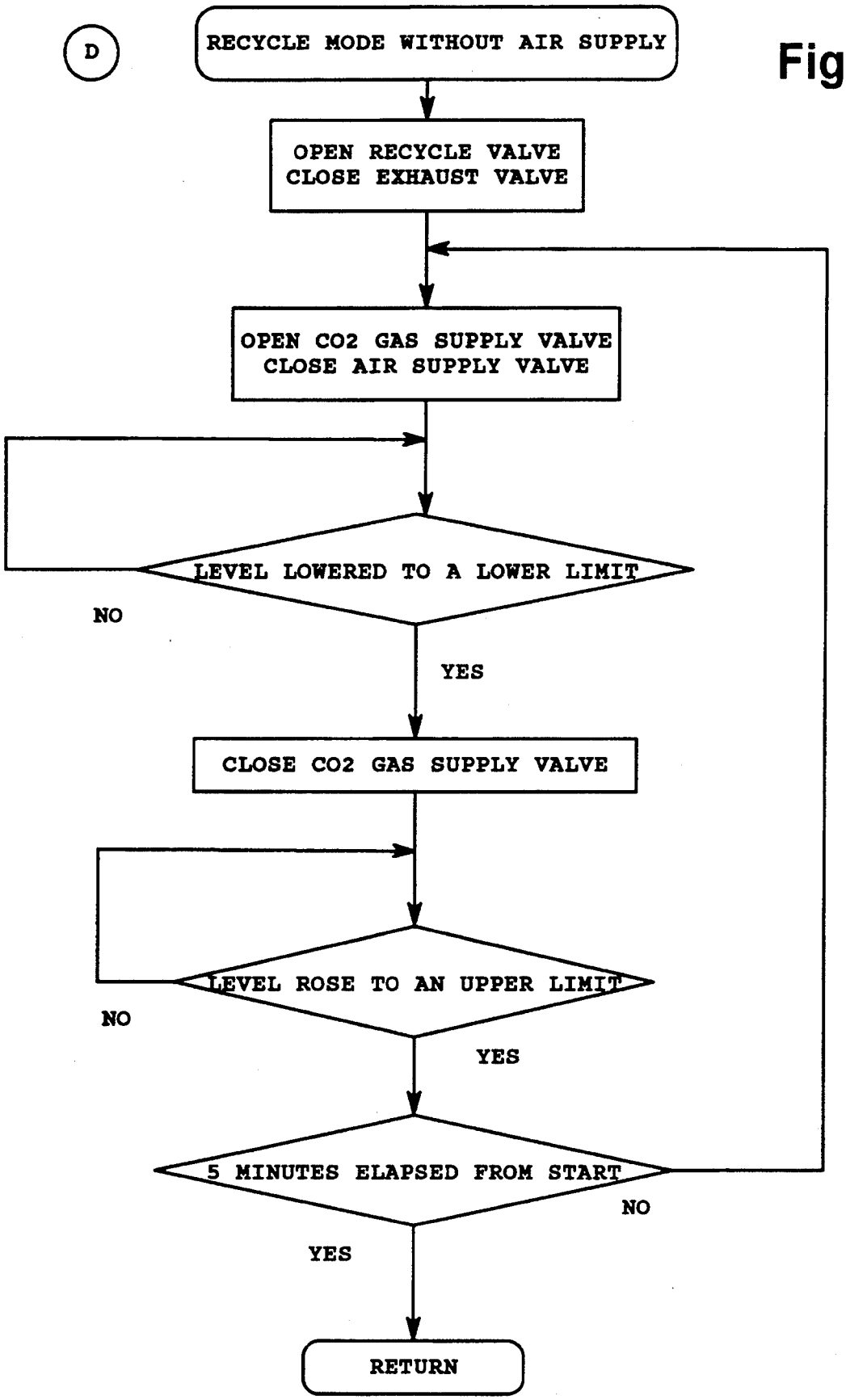

When the $CO_2$ concentration is from 70 to 95%, the control unit 80 selects the recycle mode without air supply to proceed to perform the subroutine D, as shown in FIG. 6. As the enough amount of the air is supplied together with the $CO_2$ gas through the $CO_2$ gas supply line 40, there is no need to introduce the outside air through the air supply line 50. However, the $CO_2$ gas is rather rich such that the recycling of the undissolved gas, or the $CO_2$ gas is still required from the viewpoint of saving the $CO_2$ gas. This subroutine D is identical to the subroutine C except that the air supply valve 51 is constantly closed.

Recycle-Exhaust Mode Without Air Supply

Figure 7:
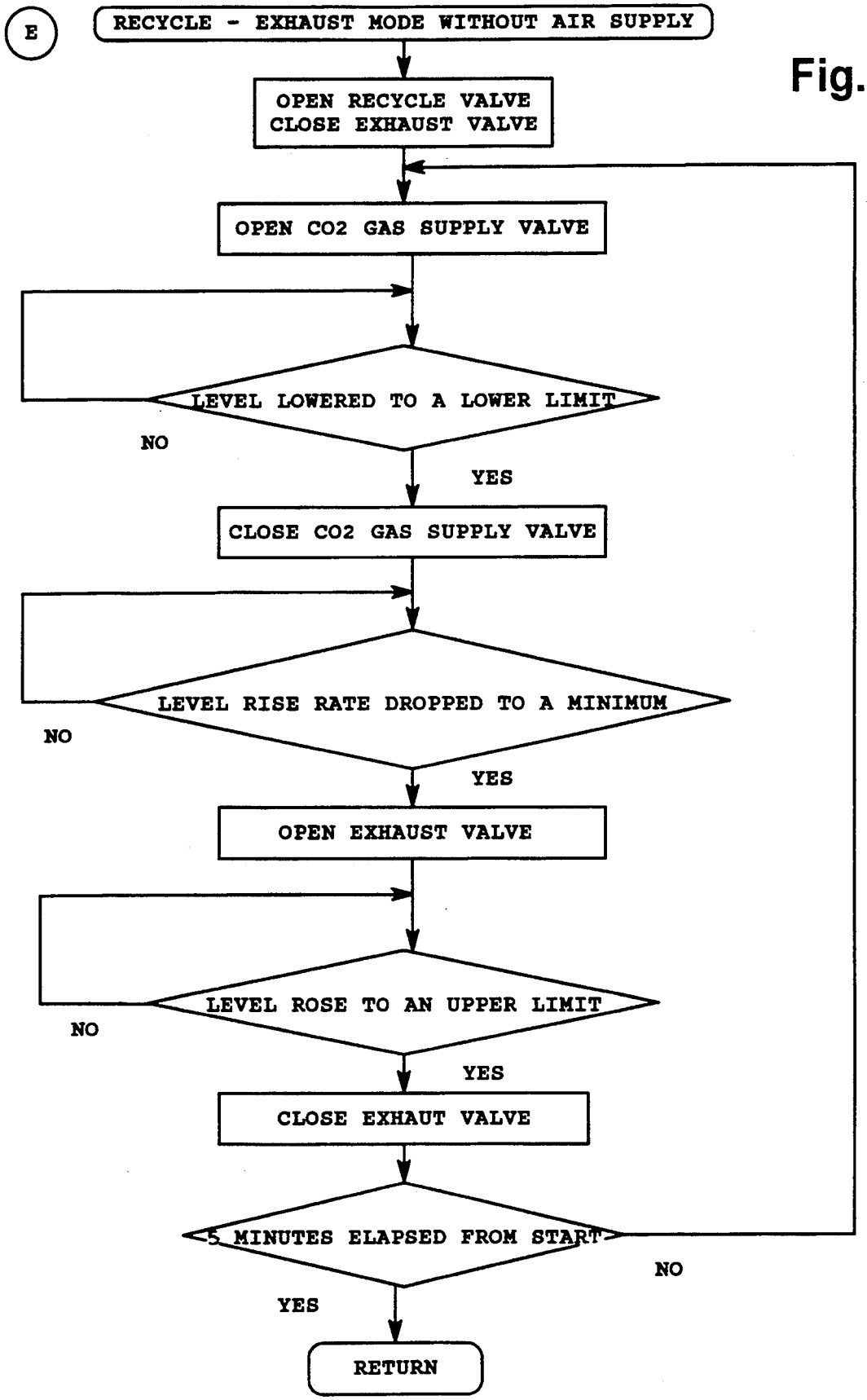

When the $CO_2$ concentration is from 50 to 70%, the recycle-exhaust mode is selected to preform the subroutine E of FIG. 7. In this condition, enough air is supplied together with the $CO_2$ gas from the source 10, the air supply valve 51 is kept closed. This mode enables the undissolved gas in the accumulator 60 to recycle in a somewhat different manner from above recycle mode. Firstly, the recycle valve 36 is opened with the exhaust valve 38 closed, after which the $CO_2$ gas supply valve 41 is opened to supply the mixture gas to the circulating bath water in the circulation path 30. After supplying a predetermined amount of the mixture gas, which is acknowledged at the control unit 80 by the lowering of the water level to the lower limit, the control unit 80 responds to close the $CO_2$ gas supply valve 41 and allows the undissolved gas to recycle in the circulation path 30. As the recycling proceeds, the level rise rate of the bath water is decreased as a consequence of that the circulating bath water becomes rather suffused with the $CO_2$ gas with a correspondingly increased proportion of the air in the undissolved gas. Upon the level rise rate having dropped to a minimum level which means that substantially only the air is kept undissolved, the control unit 80 acknowledges that the air is predominant in the undissolved gas and remains uselessly in the accumulator, and responds to open the exhaust valve 38 to expel the undissolved gas outside of the circulation path 30. With this result, the water level in the accumulator 60 is allowed to rise to the upper limit. Upon this occurrence, the control unit 80 close the exhaust valve 38 in order to avoid leakage of the bath water through the exhaust line 37, thereby completing one operation cycle. Thereafter, the control unit 80 checks whether 5 minutes have been passed from the start of the one operation cycle, and proceeds to repeat the operation cycle, if 5 minutes have not been passed. If the time is up, the subroutine is interrupted and returned to the step of $CO_2$ analysis in the initialization sequence of FIG. 3.

Exhaust Mode Without Air Supply

Figure 8:
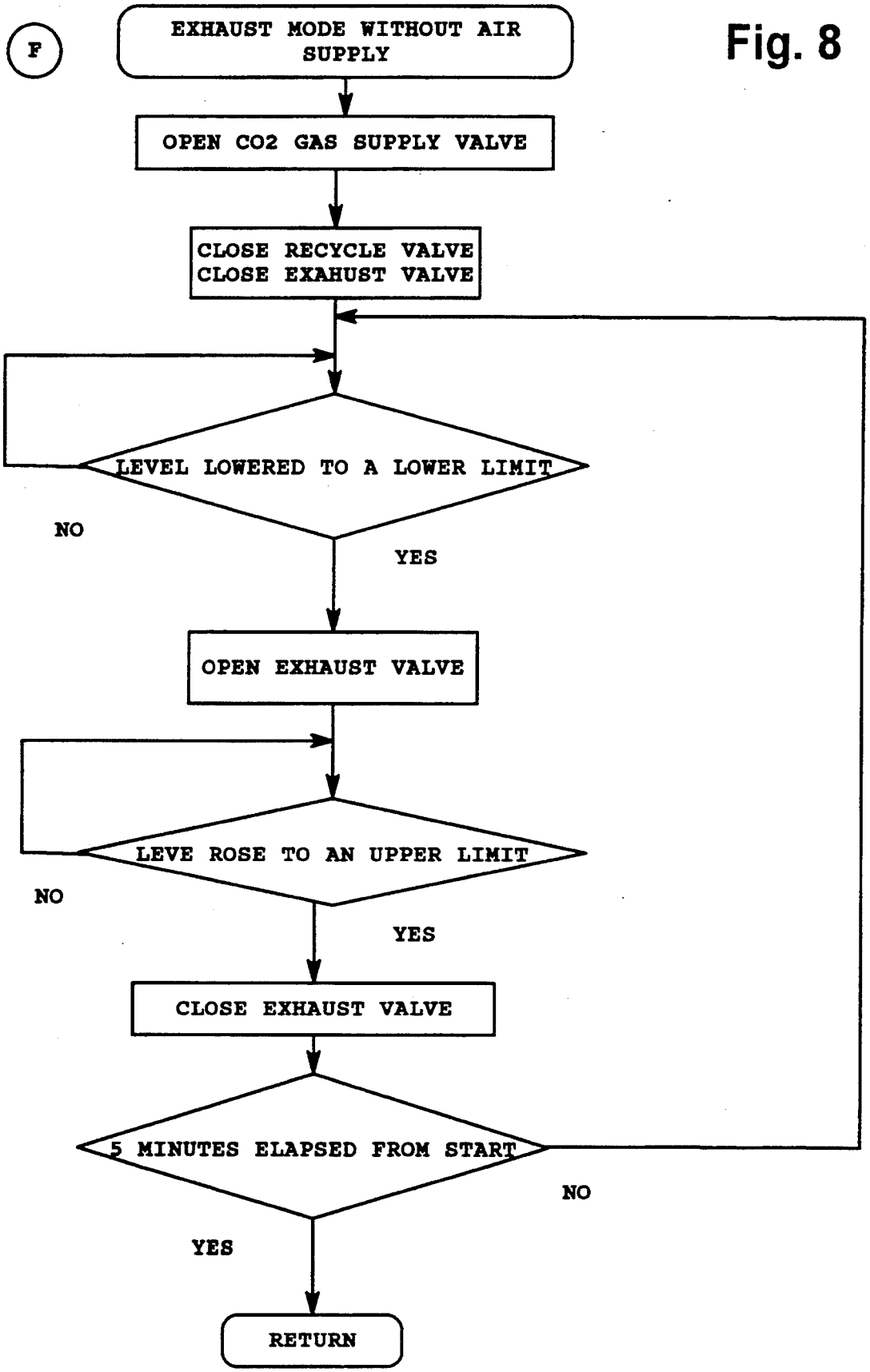

When the $CO_2$ concentration is lower than 50%, the control unit 80 selects the exhaust mode to perform the subroutine F of FIG. 8. As with the above two modes, the subroutine F is executed with the air supply valve 51 kept closed because a suitable amount of the air is supplied together with the $CO_2$ gas from the source be. In this mode, the control unit 80 keeps the $CO_2$ gas supply valve 41 opened for continuously supplying the mixture gas from the source 10 at substantially a constant flow rate to the bath water circulating in the circulation path 30 with the recycle valve 36 kept closed and with the exhaust valve 38 initially closed. As the supplying amount of the mixture gas is increased with the attendant increase of the amount of the undissolved gas, the water level in the accumulator 60 lowers. Upon the water level coming down to the lower limit which is indicative of that a considerable amount of the undissolved gas is accumulated, the control unit 80 responds to open the exhaust valve 38 to discharge the undissolved gas outside of the circulation path 30, thereby avoiding the undissolved gas from being involved as large bubbles in the bath water being introduced into the bathtub 20. After the discharging of the undissolved gas, the water level will begin to rise again due to the continuous supply of the mixture gas. When the water level rises up to the upper limit, the exhaust valve 38 is again closed to complete one operation cycle. Thereafter, the control unit 80 checks whether 5 minutes have been passed from the start of the one operation cycle, and proceeds to repeat the operation cycle, if 5 minutes have not been passed. If the time is up, the subroutine is interrupted and returned to the step of $CO_2$ analysis in the initialization sequence of FIG. 3. It is noted in this connection that the time period of 5 minutes is illustrated only by way of example, and therefore the time period may vary as necessary. Although this exhaust mode is described to be selected in response to the $CO_2$ concentration of less than 50%, this mode may be arbitrarily selected irrespective of the $CO_2$ concentration in order to accelerate the dissolving of the $CO_2$ gas into the bath water at the expense of wasting the $CO_2$ gas. Further, it should be noted that the above boundary $CO_2$ concentrations for selection between the above four modes are presented only by way of example, and therefore may vary depending upon actual system configuration, design, or capacity of the pump and the like.

Air Micro-Bubbling Bath

Figure 9:
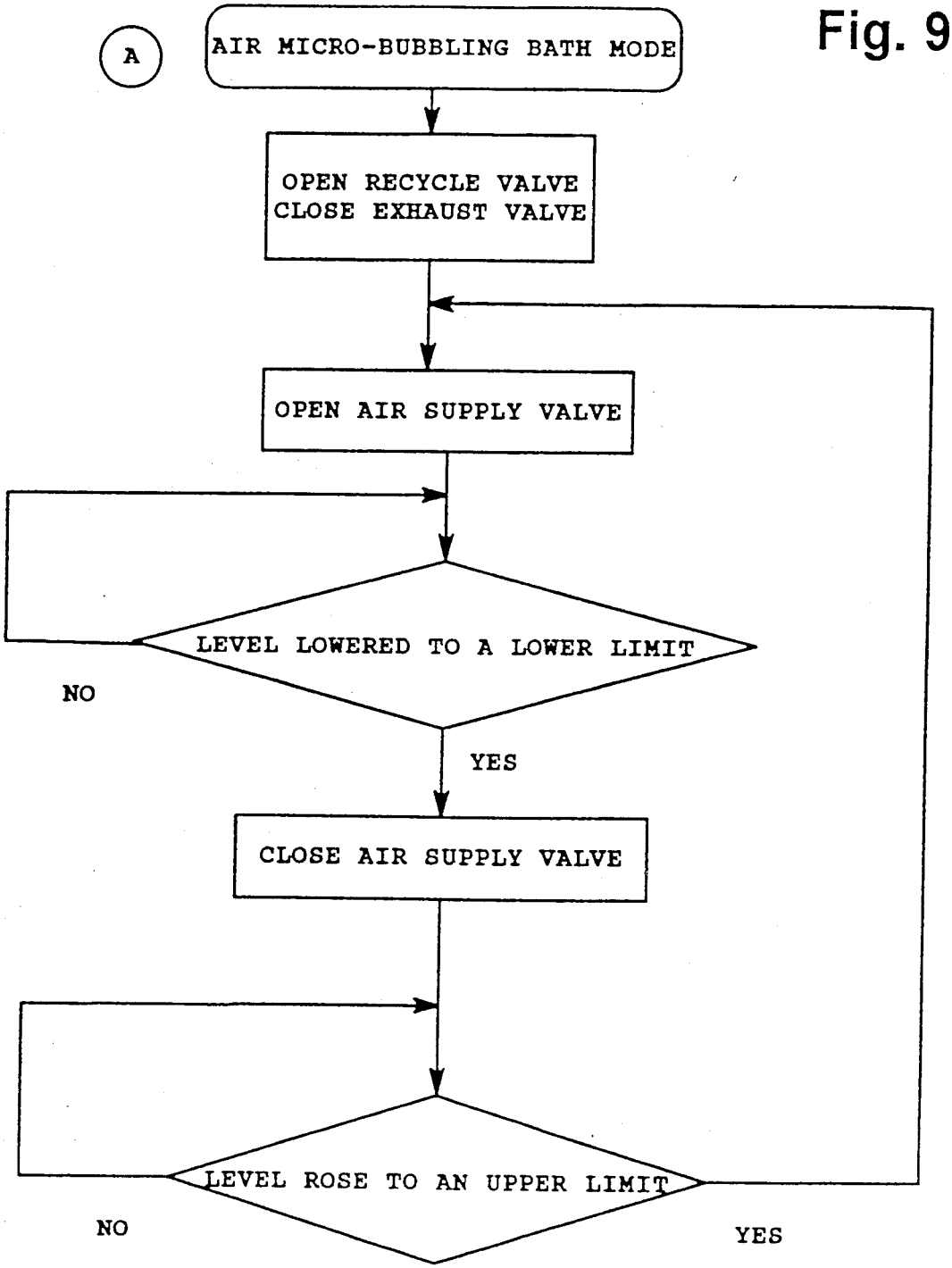

FIG. 9 illustrates a subroutine A of creating the air micro-bubbling bath. When the air micro-bubbling is selected in the initialization sequence of FIG. 3, the control unit 80 responds to open the recycle valve 36 and close the exhaust valve 38, and open the air supply valve 51 with the $CO_2$ gas supply valve 41 closed for supplying only the outside air through the air supply line 50 to the circulating bath water in the circulation path 30 to be dissolved therein by pressurization of the pump 33. After a predetermined amount of the air is supplied with the attendant lowering of the water level to the lower limit in the accumulator 60, the control unit 80 responds to close the air supply valve 51, allowing the undissolved air to recycle through the recycle line to the circulating bath water while shutting off the fresh supply of the air. When the water level rises to an upper limit, the control unit 80 acknowledges that enough amount of the air is dissolved, and responds to reopen the air supply valve 51 and repeats the same steps. Whereby the air dissolved in the bath water forms micro-bubbles when entering the bathtub 20 as being depressurized.

Figure 10:
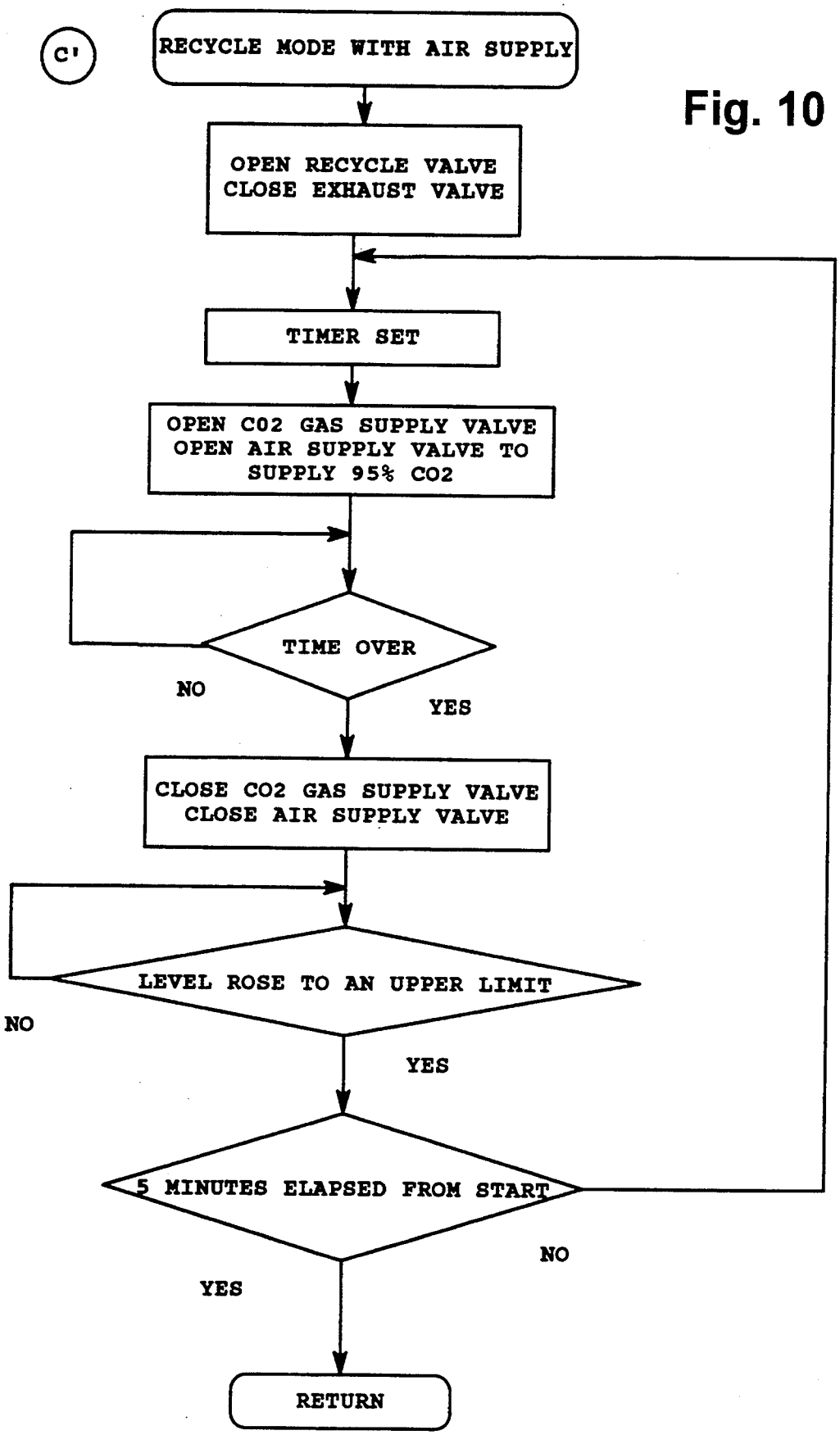

Although in the above recycle mode as well as in the recycle-exhaust mode, the supplying amount of the mixture gas to the circulating bath water is controlled based upon the level variation of the bath water in the accumulator 60, it is equally possible to use a timer for the same purpose. FIG. 10 illustrates a modified subroutine B' for the recycle mode with air supply which may be used instead of the above subroutine B. As shown in the figure, a timer is set before opening the $CO_2$ gas supply valve 41 and the air supply valve 51 to supply the mixture gas. After a predetermined time has elapsed or time is over, the control unit 80 responds to close the valves 41 and 51 to stop supplying the mixture gas, thereby assuring to supply a desired amount of the mixture gas in each operation cycle of the mode. The other steps are identical to those of FIG. 5, therefore no duplication explanation is deemed necessary.

In the above described embodiment, the $CO_2$ concentration of the supply gas from the source 10 is determined based upon the water level variation within the accumulator 60, it is of course possible to use a conventional $CO_2$ sensor in the $CO_2$ gas supply line 40. Further, it should be noted that the level sensor 70 is not limited to the structure of FIG. 2 and may comprises a float switch or electrostatic probe capable of sensing the water level variation substantially linearly. With the use of such sensor, the water level could be checked at several levels to enable more precise control based upon the water level variation.

Figure 11:
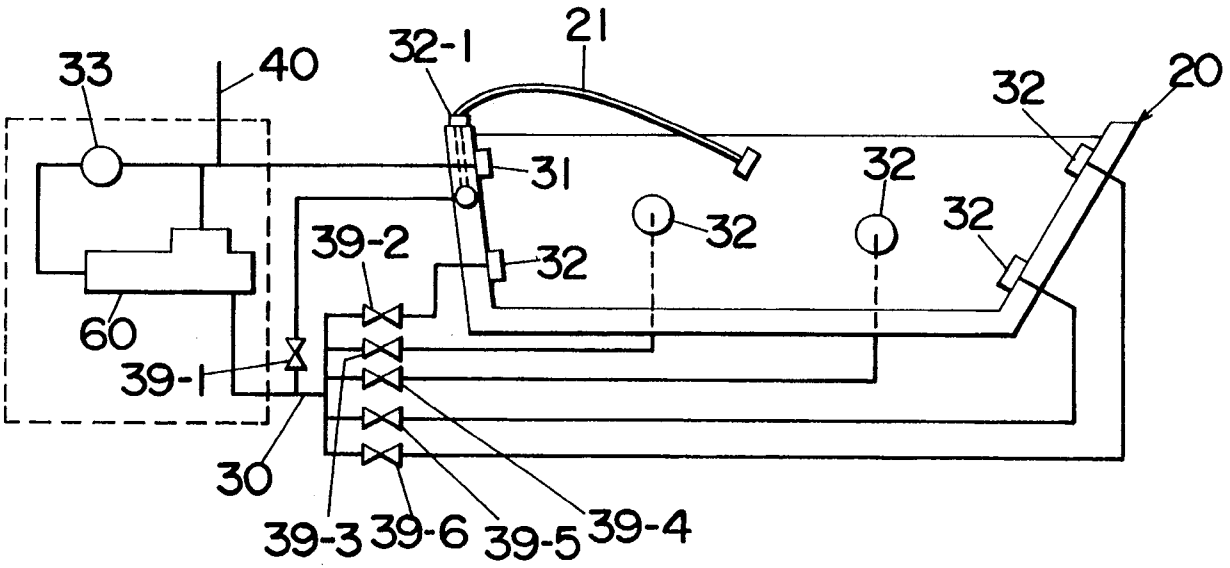
FIG. 11 is a schematic view of a modification of the above system.
Figure 12:
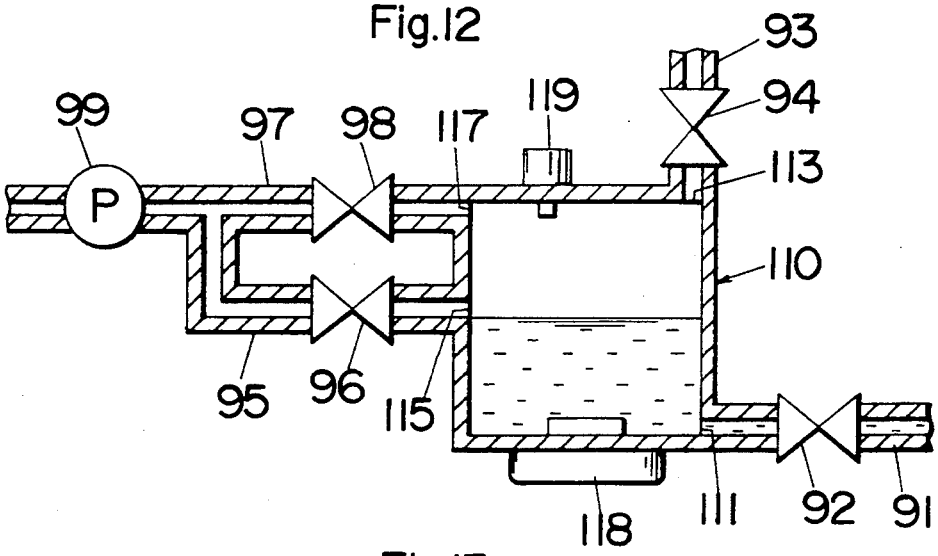
FIGS. 12 to 16 are sectional views illustrating operations of a $CO_2$ monitor utilized in the above system for monitoring $CO_2$ content of a bath water sampled from a bathtub.

Although the above embodiment is shown, for schematic representation, to have only one outlet 32 through which the pressurized bath water dissolved with the $CO_2$ gas enters the bathtub 20, the bathtub 20 may be formed with a plurality of like outlets 32, as shown in FIG. 11. These outlets 32 are commonly connected to the circulation path 30 through individual valves 39-1 to 39-6 so that any desired outlet 32 or any desired combination of the outlets 32 are made active in accordance with the preference by the user. Further, at least one of the spouts 32 may be fitted with a detachable nozzle 21 for directing the bath water to a desired portion of the user.

The $CO_2$ monitor 90, which is included in the system to indicate the dissolved content of the $CO_2$ gas in the bathtub, may be utilized to control the operation of the system in order to regulate the dissolved $CO_2$ gas content in a suitable manner, such as by varying the $CO_2$ concentration of the mixture gas supplied through the gas supply line 40 and the air supply line 50 and/or varying the operation modes. FIGS. 12 to 16 illustrate the structure of the monitor 90, which comprises a cell 10 for receiving the bath water sampled from the bathtub 20 through the inlet and the water feed channel 91 branching from the circulation path 30. The cell 110 is formed in the lower end of a side wall with an intake port 111 connected to the water feed channel 91 with a feed valve 92. Formed in the opposite side wall of the cell 110 at a middle height thereof is a drain port 115 from which the drain channel 95 extends. The drain channel 95 includes a drain valve 96 and a suction pump 99 for draining a portion of the water from the cell 110. Formed in the upper side end of the cell 110 is an auxiliary drain port 117 which is spaced upwardly from the drain port 115 and from which a sub channel 97 with a sub drain valve 98 extends to terminate in the drain channel 95 behind the suction pump 99. Also formed in the top wall of the cell 110 is an air intake port 113 which is connected to the air channel 93 with an air valve 94. The air channel 93 is connected to the air supply channel 50 upstream of the air supply valve 51 for introducing the outside air therethrough into the cell 110. An ultrasonic exciter 118 is fitted on the bottom of the cell 110 for exciting the bath water to expel the dissolved $CO_2$ gas therefrom into a gas phase. A pressure sensor 119 is fitted on the top wall of the cell 110 for sensing the pressure variation of the gas phase due to the ultrasonic excitation.

Figure 13:
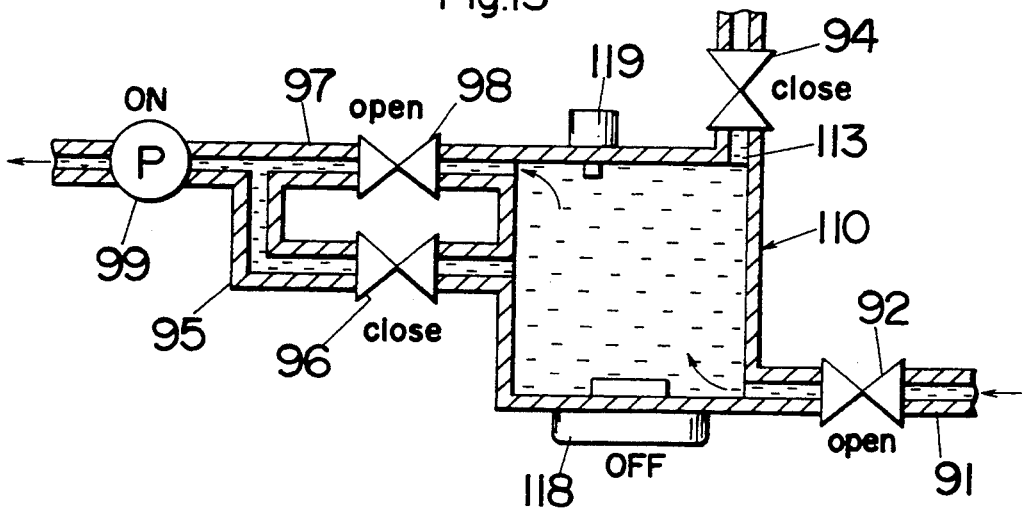
Figure 14:
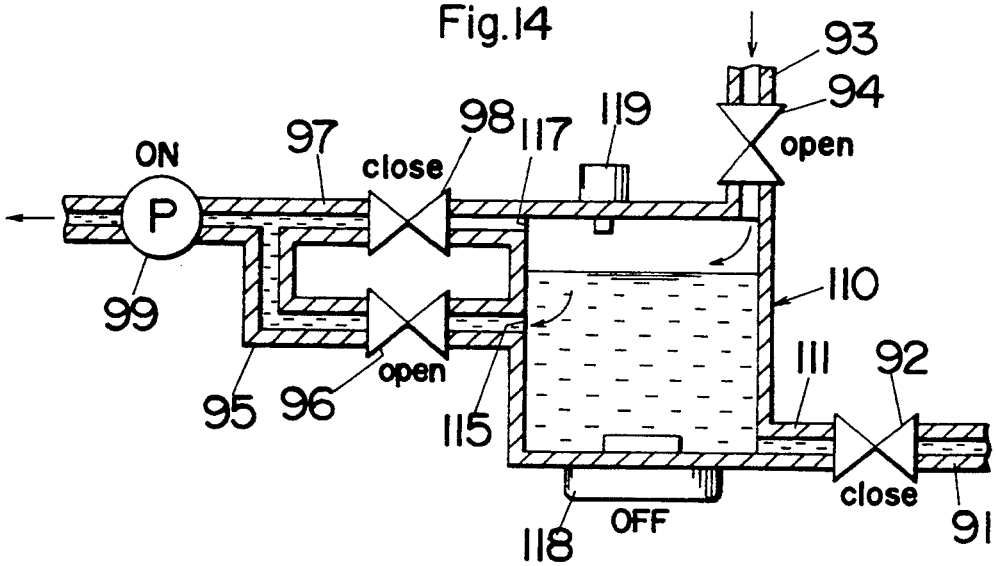
Figure 15:
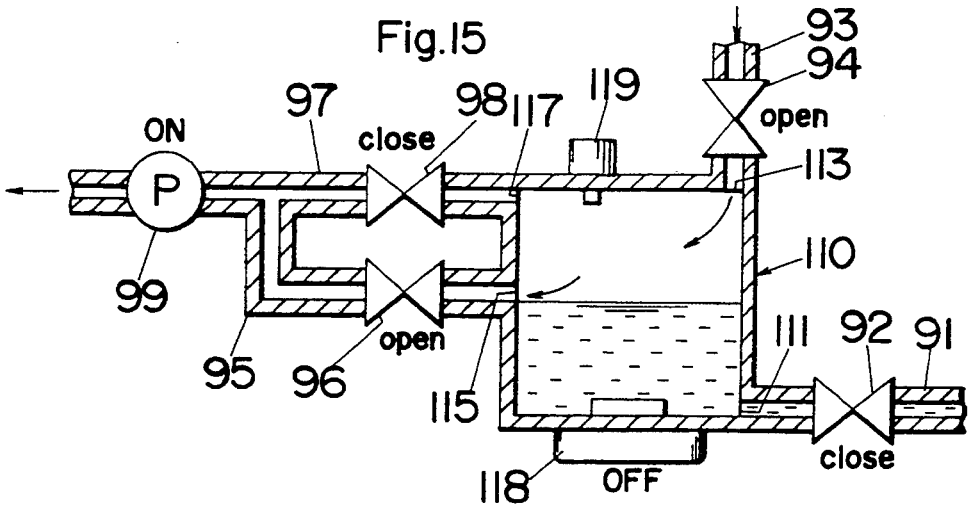
Figure 16:
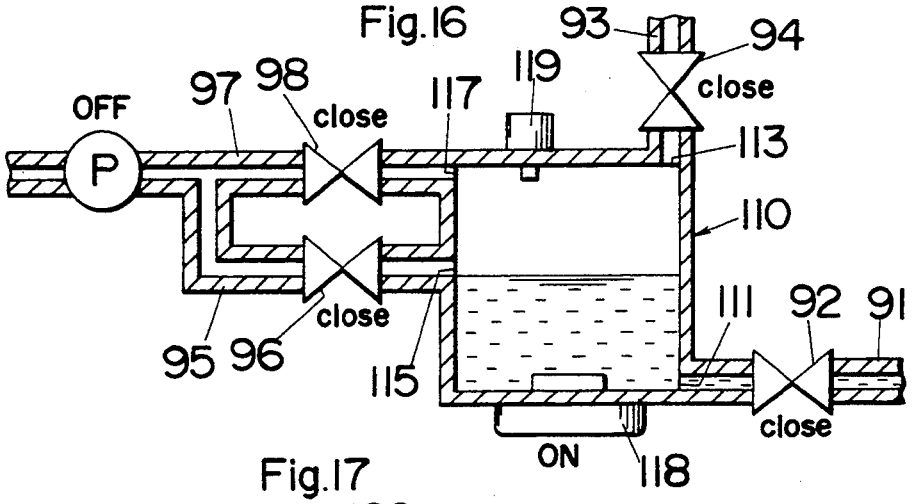
Figure 17:
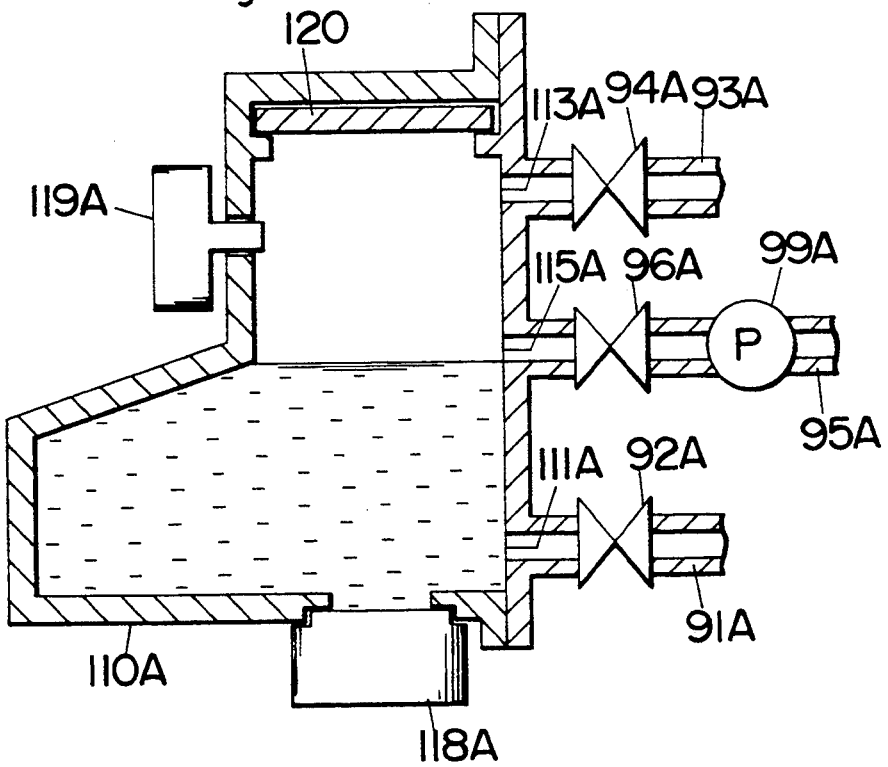
FIGS. 17 to 21 are sectional views illustrating like operations of a modified $CO_2$ monitor which may be utilized in the above system for monitoring $CO_2$ content of a bath water sampled from a bathtub.

Operation of thus constructed $CO_2$ monitor 90 will be now discussed. Firstly, as shown in FIG. 13, the suction pump 99 is turned on with the valves 92 and 98 opened and with the valves 94 and 96 closed in order to draw the bath water from the bathtub 20 into the cell 110 and fill the cell 110 with the bath water. Thereafter, the valves 92 and 98 are closed and instead the valves 94 and 96 are opened while operating the suction pump 99 in order to drain a portion of the bath water from the cell 110 outwardly during which the outside air is introduced into the cell 110. This continues until the water level of the bath water is lowered to a level corresponding to the drain port 115, as shown in FIG. 15, at which condition the gas phase is filled with the outside air and maintained at an atmospheric pressure. Upon reaching this condition, the suction pump 99 is turned off with all of the valves 92, 94, 96 and 98 closed and the ultrasonic exciter 118 comes into operation to excite the bath water, whereby the dissolved $CO_2$ gas is rapidly expelled into the gas phase to increase the pressure level thereof. The pressure sensor 119 detects thus increased pressure level and processes it to determine a content of the $CO_2$ gas that has been dissolved in the bath water based upon a known relation between the pressure variation and the $CO_2$ gas content in the water. The output of the pressure sensor 119 is fed to the control panel for indication of thus determined $CO_2$ gas content. After monitoring the $CO_2$ gas content, the $CO_2$ monitor 90 is reset into the condition of FIG. 13 where the cell is filled with fresh bath water so that the system is ready to detect the $CO_2$ gas content of the fresh bath water. In this manner, the monitoring can be made at any desired time.

Figure 18:
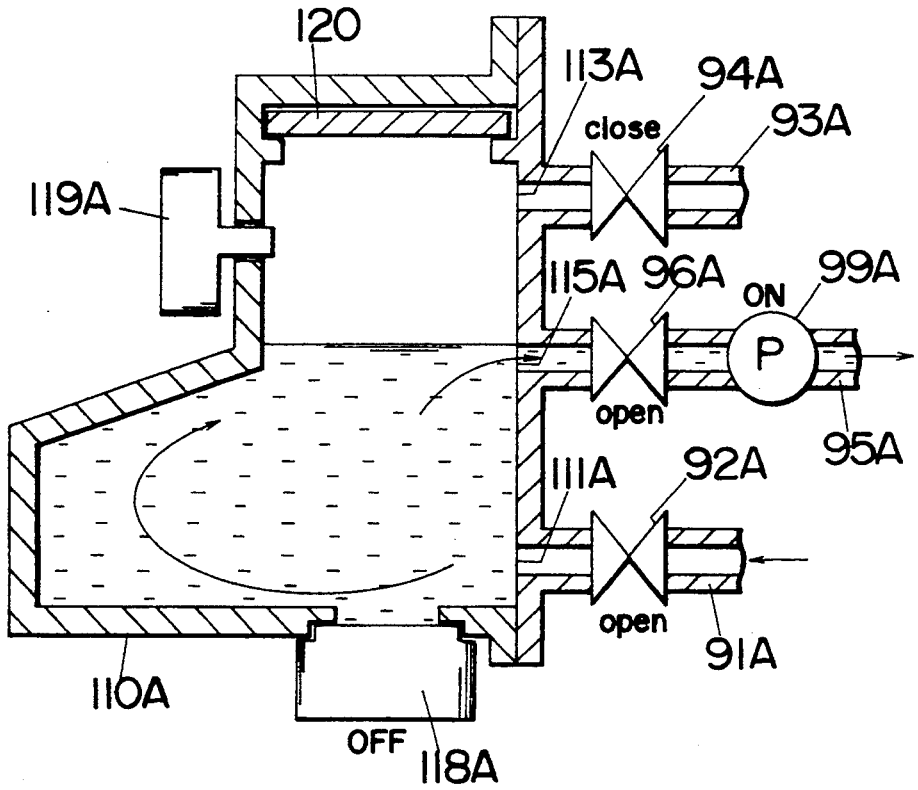
Figure 19:
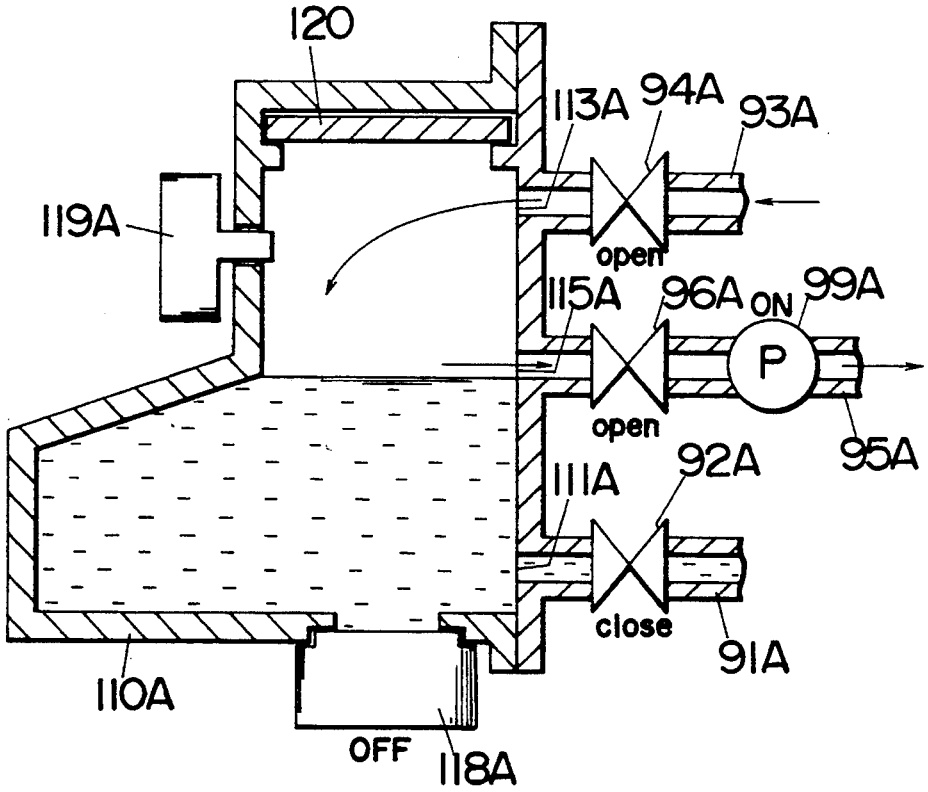
Figure 20:
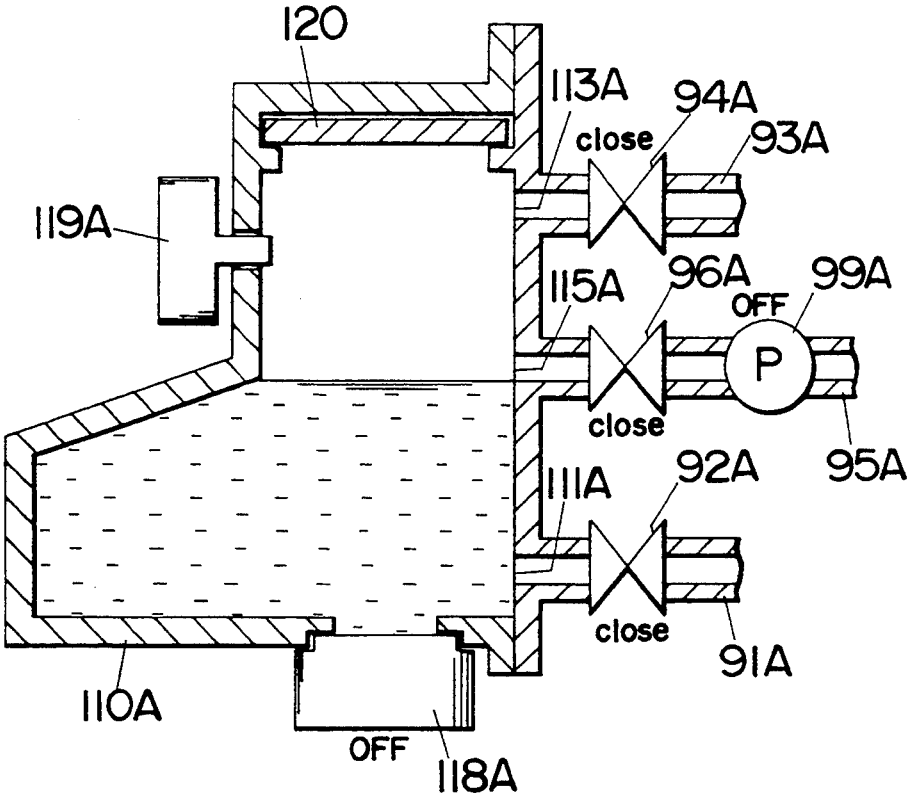
Figure 21:
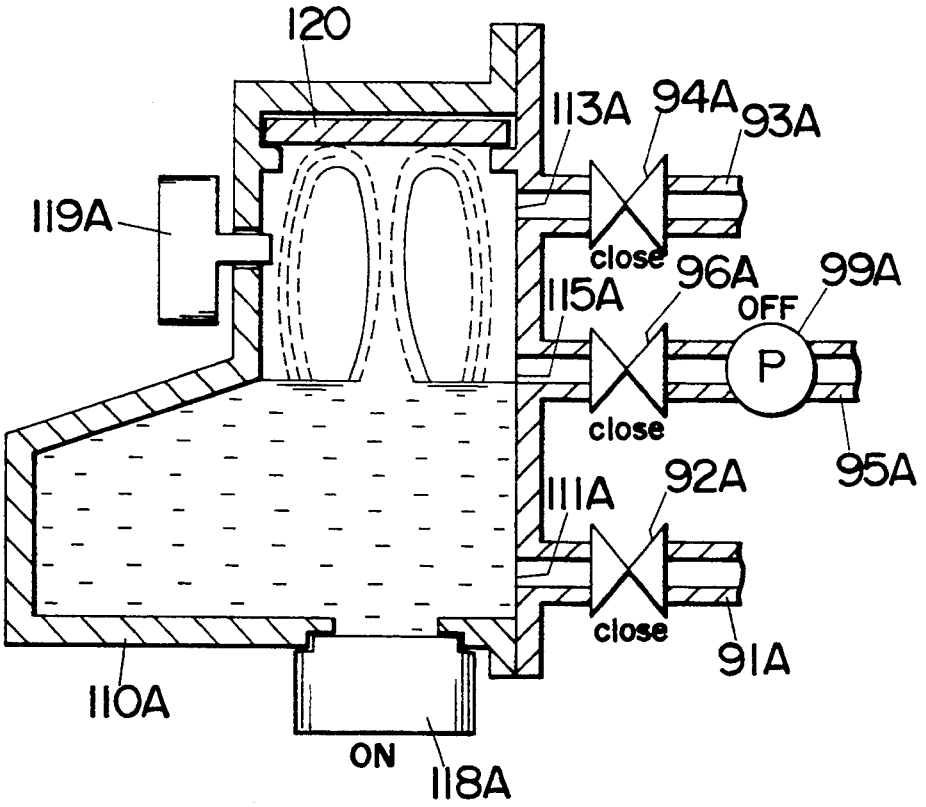

FIGS. 17 to 21 illustrates a modified $CO_2$ monitor which may be utilized in the invention. The $CO_2$ monitor comprises a like cell 110A made of a plastic material for storing the bath water sampled from the bathtub 20. The cell 110A is formed with an intake port 111A, a drain port 115A, and air intake port 113A which are arranged in a side wall of the cell 110A and connected to a water feed channel 91A with a feed valve 92A, a drain channel 95A with a drain valve 96A, and a air channel 93A with an air valve 94A, respectively. The drain channel 95A is provided with a suction pump 99A for drawing the bath water from the bathtub 20 through the inlet port 31 and through the water feed channel 91A. The cell 110A is also provided with an ultrasonic exciter 118A on the bottom thereof and with an pressure sensor 119A at the upper end portion thereof. Operation of this $CO_2$ monitor will be discussed with reference to FIGS. 18 to 21. Firstly, the suction pump 99A is turned on with the feed valve 92A and drain valve 96A opened and with the air valve 94A closed in order to draw the bath water into the cell while draining it out through the drain channel 95A, as shown in FIG. 18, thereby continuously refreshing the bath water within the cell 110A. Thereafter, as shown in FIG. 19, the feed valve 92A is closed while keep operating the suction pump 99A with the drain valve 96A and the air valve 94A opened in order to circulate the outside air through the cell 110A, thereby fixing the water level of the bath water in the cell at a level corresponding to the drain port 115A to form thereabove a gas phase which is kept at an atmospheric pressure. After the water level is stabilized, the suction pump 99A is turned off and at the same time all of the valves 92A, 94A, and 96A are closed, as shown in FIG. 20. Then, the ultrasonic exciter 118A is turned on to splash the bath water into the gas phase, as shown in FIG. 21, thereby rushing out the dissolved $CO_2$ gas into the gas phase to increase the pressure level of the cell. The pressure sensor 119A senses such pressure increase and determines therefrom a $CO_2$ gas content of the bath water and provide a corresponding output to the control panel for indication of the $CO_2$ gas content. It is noted in this connection that the ultrasonic exciter 118A employed in this instance has a great power to splash the water violently for expediting the separation of the $CO_2$ gas into the gas phase in a very short time. With this result, the splashing water will collide against the upper bottom of the cell 110A made to thereby heat it up considerably. To protect the plastic-made cell 110A from being heat-damaged, the cell 110A is provided at the upper bottom with a heat-resistive plate 120, for example, made of a stainless steel or the like.

It is noted that the above $CO_2$ monitor can be well adapted to analyzing the $CO_2$ gas contents not only of the bath water but also of other carbonated liquids or beverages such as beers and sparkling wines.

What is claimed is:

1. A carbonate spring bath system for creating a bath water dissolved with carbon dioxide gas and supplying the same to a bathtub, said system comprising:

a source of supplying a concentrated $CO_2$ gas;

a circulation path adapted to be connected to said bathtub at an inlet and an outlet and including a booster pump for circulating to introduce a bath water through said inlet from said bathtub and feeding the same back thereto through said outlet as a pressurized bath water;

a $CO_2$ gas supply line connected to said circulation path upstream of said booster pump to feed said concentrated $CO_2$ gas from said source to said bath water circulating in said circulation path;

an air supply line connected to said circulation path upstream of said booster pump to feed an outside air to said bath water circulating in said circulation path;

said $CO_2$ gas supply line and said air supply line being provided respectively with valves which are opened and closed so as to provide to said circulation path said $CO_2$ gas and said air at a suitable mixture ratio thereof such that said $CO_2$ and said air are forced by said booster pump to dissolve in said pressurized bath water under a pressurized condition;

an accumulator disposed in said circulation path downstream of said booster pump for separating undissolved gas involved in said bath water, said accumulator having a water chamber for temporarily storing said pressurized bath water and a gas chamber for storing the undissolved gas emanating from said pressurized water;

a recycle line connecting said gas chamber in said accumulator to said circulation path upstream of said booster pump so as to return said undissolved gas to said circulation path for recycling of said undissolved gas;

an exhaust line connected to said gas chamber for exhausting said undissolved gas outside of said circulation path;

said recycle line and exhaust line being provided respectively with valves which are selectively opened and closed such that the system is capable of selectively operating a recycle mode in which the undissolved gas is fed back to the circulating bath water and an exhaust mode in which said undissolved gas is exhausted outside of the circulation path.

2. A carbonate spring bath system as set forth in claim 1, further including a $CO_2$ sensor for detecting a $CO_2$ concentration in a mixture of said $CO_2$ gas and said air being fed to said bath water in said circulation path and providing an output indicative of the detected $CO_2$ concentration to a control unit, said control unit responding to open and close the valves of said recycle and exhaust lines for selecting operation between said recycle mode and said exhaust mode.

3. A carbonate spring bath system as set forth in claim 2, wherein said control unit further responding, based upon the output of said $CO_2$ sensor, to open and close said valves in said $CO_2$ gas supply line and said air supply line to keep supplying said $CO_2$ gas and said air at a predetermined mixture ratio.

4. A carbonate spring bath system as set forth in claim 2, wherein said accumulator is provided with a level sensor which senses a water level of the bath water in said accumulator, said control unit defining said $CO_2$ sensor with said level sensor and controlling to open said $CO_2$ gas line for a limited time period to supply a predetermined amount of the concentrated $CO_2$ gas through said $CO_2$ gas line to the bath water circulating in said circulation path, operating said booster pump in order to dissolve said concentrated $CO_2$ gas into said bath water with said recycle line opened and with said exhaust line closed while sensing a level variation of the bath water in said accumulator by said level sensor as a consequence of said $CO_2$ gas being dissolved in said bath water, determining a level rise rate of said bath water to be indicative of the concentration of the $CO_2$ gas supplied from said source.

5. A carbonate spring bath system as set forth in claim 1, wherein said recycle line and said exhaust line are provided respectively with constrictors for regulation of fluids flowing therethrough.

6. A carbonate spring bath system as set forth in claim 1, wherein said outlet of the bathtub comprises a plurality of spouts.

7. A carbonate spring bath system as set forth in claim 1, wherein said outlet of the bathtub includes a detachable nozzle.

8. A carbonate spring bath system as set forth in claim 1, further including a $CO_2$ monitor, adapted to be connected by a line to the bathtub, which monitors a $CO_2$ content of the bath water sampled from said bathtub and provides and output indicative of the $CO_2$ content to a display for indication of the monitored $CO_2$ content.

9. A carbonate spring bath system as set forth in claim 8, including control means which, in response to the output from said $CO_2$ monitor, controls operation of the valves for the recycle line and the exhaust line so as to change the dissolved content of the $CO_2$ gas in the bath water within the bathtub.

10. A carbonate spring bath system as set forth in claim 8, wherein said $CO_2$ monitor comprises:

a cell adapted to receive therein the bath water from said bathtub and capable of being sealed;

a water feed channel with a feed valve connected to supply the bath water into said cell;

a drain channel connected to said cell at a portion upwardly of the connection of said water feed channel to said cell, said drain channel provided with a suction pump for drawing the bath water into said cell and draining a portion of the bath water therefrom in order to set a desired water level, thereby forming within said cell a gas phase upwardly of said water level, said drain channel provided with a drain valve;

an air channel with an air valve for introducing outside air into said cell to fill said gas phase with the outside air at an atmospheric pressure;

a pressure sensor for sensing a pressure within said cell; and an ultrasonic exciter for exciting said bath water to expel the dissolved $CO_2$ gas therefrom into said gas phase, said ultrasonic exciter controlled to be activated with said feed valve, drain valve, and air valve closed such that the pressure sensor can sense a pressure variation within said gas phase to determine the dissolved $CO_2$ gas content in said bath water based upon the pressure variation.

11. A carbonate spring bath system as set forth in claim 10, further including a sub channel extending from said cell at a portion upwardly of the connection of the drain channel to said cell, said sub channel leading to said suction pump common to said drain channel and cooperative with said drain channel to discharge the bath water and the air from within said cell.

12. A carbonate spring bath system as set forth in claim 10, wherein said ultrasonic excitor is selected to splash the bath water in said cell to expel the dissolved $CO_2$ gas into said gas phase.

13. A carbonate spring bath system as set forth in claim 12, wherein said cell is fabricated from a plastic material and is provided with a heat-resistive plate which is disposed in said gas phase at a portion exposed to the bath water being splashed into said gas phase by said ultrasonic exciter for protection of said cell from being damaged by heat associated with the splashing of said bath water by said ultrasonic exciter.

14. A carbonate spring bath system for creating a bath water dissolved with $CO_2$ gas and supplying the same to a bathtub, said system comprising:

a circulation path adapted to be connected to said bathtub at an inlet and an outlet and including a booster pump for circulating to introduce a bath water through said inlet from said bathtub and feeding the same back thereto through said outlet as a pressurized bath water;

gas supply lines connected to said circulation path upstream of said booster pump to feed a mixture of said $CO_2$ gas and the air to said bath water circulating in said circulation path;

said gas supply lines provided with valves which are controlled to open and close to periodically supply said mixture to said circulation path such that the $CO_2$ and the air are forced by said booster pump to dissolve in said pressurized bath water under a pressurized condition;

an accumulator disposed in said circulation path downstream of said booster pump, said accumulator having a water chamber for temporarily storing said pressurized bath water and a gas chamber for storing an undissolved gas emanating from said pressurized water;

a recycle line connecting said gas chamber in said accumulator to said circulation path upstream of said booster pump so as to return said undissolved gas to said circulation path for recycling of said undissolved gas;

said accumulator provided with a level sensor which monitors a water level of the bath water in said accumulator, control means opening and closing said gas supply lines to supply the mixture gas to the bath water in said circulation path, said control means providing a recycle mode in which said gas supply lines are kept closed after supplying a certain amount of said mixture gas to the circulating bath water in order to feed back the undissolved gas from the accumulator to the circulating bath water until the water level in said accumulator rises to a predetermined upper limit.

15. A carbonate spring bath system as set forth in claim 14, wherein said control means is cooperative with said level sensor to close said gas supply lines when said water level is lowered to a lower limit level, thereby limiting the amount of said mixture gas which is to be supplied to the circulating bath water in said circulation path and is to be dissolved in said bath water in said recycle mode.

16. A carbonate spring bath system for creating a bath water dissolved with $CO_2$ gas and supplying the same to a bathtub, said system comprising:

a circulation path adapted to be connected to said bathtub at an inlet and an outlet and including a booster pump for circulating to introduce a bath water through said inlet from said bathtub and feeding the same back thereto through said outlet as a pressurized bath water;

gas supply lines connected to said circulation path upstream of said booster pump to feed a mixture gas of the $CO_2$ gas and the air to said bath water circulating in said circulation path;

said gas supply lines provided with valves which are controlled to open and close to periodically supply said mixture to said circulation path such that the $CO_2$ and the air are forced by said booster pump to dissolve in said pressurized bath water under a pressurized condition;

an accumulator disposed in said circulation path downstream of said booster pump, said accumulator having a water chamber for temporarily storing said pressurized bath water and a gas chamber for storing an undissolved gas emanating from said pressurized water;

a recycle line connecting said gas chamber in said accumulator to said circulation path upstream of said booster pump so as to return said undissolved gas to said circulation path for recycling of said undissolved gas;

an exhaust line connected to said gas chamber for exhausting said undissolved gas outside of said circulation path;

said accumulator provided with a level sensor which monitors a water level of the bath water in said accumulator;

control means opening and closing said gas supply lines to supply the mixture gas to the bath water in said circulation path, said control means providing a recycle mode and an exhaust mode alternately based upon a variation in said water level in said accumulator, said recycle mode starting after receiving a certain amount of the mixture gas to keep feeding back the undissolved gas from the accumulator to said circulation path with said gas supply lines closed and said exhaust line closed until rising rate of said water level in said accumulator decreased to a certain value, after which said control means starts said exhaust mode in which said exhaust line is opened to escape the undissolved gas outside of said circulation path until said water level reaches a predetermined upper limits.

17. A carbonate spring bath system as set forth in claim 16, wherein said control means is cooperative with said level sensor to close said gas supply lines when said water level is lowered to a predetermined lower limit level, thereby limiting the amount of said mixture gas which is to be supplied to the circulating bath water in said circulation path and is to be dissolved in said bath water in said recycle mode.

18. A carbonate spring bath system for creating a bath water dissolved with $CO_2$ gas and supplying the same to a bathtub, said system comprising:

a recirculation path adapted to be connected to said bathtub at an inlet and an outlet and including a booster pump for recirculating to introduce a bath water through said inlet from said bathtub and feeding the same back thereto through said outlet as a pressurized bath water;

gas supply lines connected to said recirculation path upstream of said booster pump to feed said mixture gas of the $CO_2$ gas and the air to said bath water recirculating in said recirculation path;

said gas supply lines provided with a valve which are controlled to open and close to periodically supply said mixture to said recirculation path such that the $CO_2$ and the air are forced by said booster pump to dissolve in said pressurized bath water under a pressurized condition;

an accumulator disposed in said recirculation path downstream of said booster pump, said accumulator having a water chamber for temporarily storing said pressurized bath water and a gas chamber for storing an undissolved gas emanating from said pressurized water;

an exhaust line connected to said gas chamber for exhausting said undissolved gas outside of said recirculation path;

said accumulator provided with a level sensor which monitors a water level of the bath water in said accumulator;

control means providing an exhaust mode in which said gas supply lines are kept open for continuously supplying the mixture gas at substantially a constant flow rate to the bath water in said recirculation path while periodically opening and closing said exhaust line in such a manner that said exhaust line is opened when said water level is sensed to drop to a predetermined lower limit and is closed when said water level is sensed to rise to a predetermined upper limit.

* * * * *

UNITED STATES PATENT AND TRADEMARK OFFICE
CERTIFICATE OF CORRECTION

PATENT NO.: 5,347,665
DATED : September 20, 1994
INVENTOR(S): KUMON et al.

It is certified that error appears in the above-identified patent and that said Letters Patent is hereby corrected as shown below:

On the cover page Item [75], line 6, "Kenji Koi" should read --Kenji Doi--.

Signed and Sealed this

Seventh Day of February, 1995

*Attest:*

Bruce Lehman

BRUCE LEHMAN

*Attesting Officer*

*Commissioner of Patents and Trademarks*